US009480336B1

(12) United States Patent
Garland et al.

(10) Patent No.: US 9,480,336 B1
(45) Date of Patent: Nov. 1, 2016

(54) MOTION FURNITURE WITH DEPLOYABLE HEADREST

(71) Applicant: American Leather Operations, LLC, Dallas, TX (US)

(72) Inventors: Thomas A. Garland, Palmetto, FL (US); Glenn Wiecek, Bradenton, FL (US); Douglas L. Gasal, Dallas, TX (US); Kevin Nguyen, Carrollton, TX (US)

(73) Assignee: American Leather Operations, LLC, Dallas, TX (US)

( * ) Notice: Subject to any disclaimer, the term of this patent is extended or adjusted under 35 U.S.C. 154(b) by 0 days.

(21) Appl. No.: 14/687,103

(22) Filed: Apr. 15, 2015

(51) Int. Cl.
*A47C 1/036* (2006.01)
*A47C 7/38* (2006.01)
*A47C 7/40* (2006.01)

(52) U.S. Cl.
CPC ..... *A47C 1/036* (2013.01); *A47C 7/38* (2013.01); *A47C 7/40* (2013.01)

(58) Field of Classification Search
CPC ..... A47C 1/032; A47C 1/035; A47C 1/036; A47C 1/037; A47C 7/38; A47C 7/40
See application file for complete search history.

(56) References Cited

U.S. PATENT DOCUMENTS

| | | | | |
|---|---|---|---|---|
| 439,303 | A | 10/1890 | Newton | |
| 3,057,657 | A * | 10/1962 | Fletcher | A47C 1/037 297/61 |
| 3,104,912 | A * | 9/1963 | Schliephacke | A47C 1/036 297/61 |
| 3,140,117 | A * | 7/1964 | Fletcher | A47C 1/037 297/403 |
| 3,738,706 | A | 6/1973 | Caldemeyer | |
| 3,836,197 | A * | 9/1974 | Goff | A47C 1/037 297/391 |
| 3,856,346 | A * | 12/1974 | Herman | A47C 1/0347 297/318 |
| 3,942,835 | A | 3/1976 | Harrison | |
| 4,188,062 | A | 2/1980 | Rogers et al. | |
| 4,451,081 | A * | 5/1984 | Kowalski | A47C 7/38 297/404 |
| 4,691,961 | A | 9/1987 | Rogers et al. | |
| 4,830,429 | A | 5/1989 | Petitjean | |
| 5,044,692 | A | 9/1991 | Tidwell et al. | |
| 5,310,243 | A * | 5/1994 | Pine | A47C 7/38 297/403 |
| RE34,666 | E | 7/1994 | Tacker | |
| 5,340,191 | A | 8/1994 | May | |
| 6,769,734 | B2 | 8/2004 | Tacker | |
| 7,201,438 | B2 * | 4/2007 | Reinsch | A47C 1/036 297/61 |
| 7,862,110 | B2 | 1/2011 | Rogers | |
| 2015/0342352 | A1 * | 12/2015 | Fischer | A47C 1/036 297/61 |

FOREIGN PATENT DOCUMENTS

| | | |
|---|---|---|
| EP | 1537805 | 4/2010 |

* cited by examiner

*Primary Examiner* — Philip Gabler
(74) *Attorney, Agent, or Firm* — Womble Carlyle Sandridge & Rice, LLP

(57) ABSTRACT

The present disclosure describes a seat. The seat may include a stationary support frame at least partially defining a cavity. The seat may also include a backrest cushion, a headrest, and a motion mechanism. The motion mechanism has a headrest assembly allowing movement of the headrest between a retracted position and an extended position. When the headrest is in the retracted position, the headrest is hidden from view within the cavity of the support frame. When the headrest is in the extended position, the headrest is visible above the backrest cushion.

22 Claims, 27 Drawing Sheets

MOTION FURNITURE WITH DEPLOYABLE HEADREST

FIELD OF THE DISCLOSURE

The present disclosure relates to furniture having a reclineable backrest either in the form of a recliner style chair or as a sofa with at least one segment having a reclineable backrest. More particularly, the present disclosure is related to reclineable furniture having an adjustable headrest.

BACKGROUND

Recliners, and other motion upholstery, such as sofas, with one or more reclining seat segments, are very popular for their style and comfort. Some recliners support a user's head in the reclined position by providing a dedicated headrest portion permanently positioned above a backrest cushion. An example of such a chair can be understood from the Comfort Recliner™ available from American Leather. While these recliners are exceptionally comfortable, the appearance provided by the relatively fixed headrest may not suit every customer's style.

Other recliners fall into a category generally referred to as high-back chairs with a back cushion that extends a significant height above the seat cushion to provide support to the user's head in the reclined position. These high-back chairs are often bulky, and again may not suit every customer's style preferences.

Still other recliners may provide a lower profile by using a relatively short back portion and backrest cushion, but these recliners may not provide the preferred level of support to a user's head when the seat is reclined, especially if the user is taller than the average consumer.

Therefore there remains a need for furniture that provides a desirable low-back style in an upright position, while providing the desired head support while in a reclined position and without compromising the appearance of the recliner in an upright position.

SUMMARY

In some embodiments, the present disclosure describes a seat that may include a stationary support frame at least partially defining a cavity. The seat may also include a backrest cushion, a headrest, and a motion mechanism. The motion mechanism has a headrest assembly allowing movement of the headrest between a retracted position and an extended position. When the headrest is in the retracted position, the headrest is hidden from view within the cavity of the support frame. When the headrest is in the extended position, the headrest is visible above the backrest cushion.

In some other embodiments, the present disclosure describes a seat that may comprise a stationary support frame at least partially defining a fixed back of the seat. The seat may also include a backrest cushion, a headrest, and a motion mechanism. The motion mechanism comprises a recline assembly configured to allow motion of the backrest cushion between an upright position and a reclined position. The motion mechanism also comprises a headrest assembly configured to allow motion of the headrest between a retracted position and an extended position. In the retracted position, the headrest is positioned behind and below a top surface of the backrest cushion, between the backrest cushion and the fixed back.

In yet other embodiments, the present disclosure describes a seat comprising an outer support frame defining a closed, stationary back, sides, and top of the seat. The seat also includes a backrest cushion, a headrest, and a headrest assembly configured to allow motion of the headrest between a hidden, retracted position and an extended position. The seat is free from seams or gaps, when viewed from the top, back, front, and sides, that would indicate the presence of the headrest when the headrest is in the retracted position.

Further, the present disclosure also describes a seat comprising a backrest cushion and a deployable headrest. The deployable headrest is movable between an extended position above the backrest cushion and a retracted position behind the backrest cushion. A flap extends downwardly from near a bottom edge of the headrest. The flap is positioned to prevent rearward displacement of the backrest cushion when the headrest is in the extended position and during movement of the headrest to the retracted position.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Figure 1:
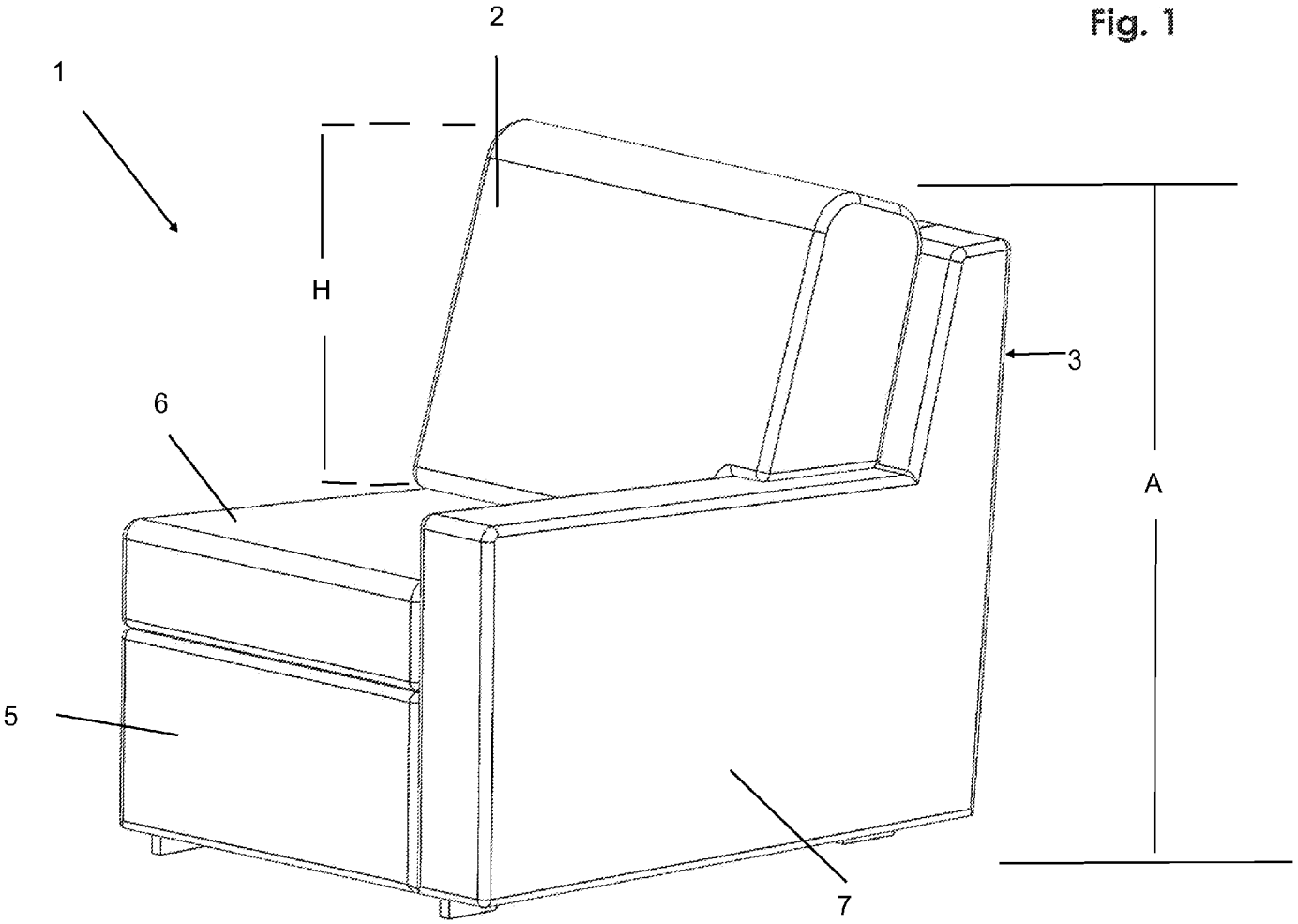
FIG. 1 shows a perspective view of a seat according to embodiments of the present disclosure with the seat in a fully closed position with the footrest closed and the backrest upright.

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

The present disclosure describes a seat 1 having a reclineable backrest with a deployable headrest. In most embodiments, the seat 1 also includes a deployable footrest. As used herein, the term "seat" is used to include furniture pieces capable of supporting one or more users in a seated position. The term "seat" includes furniture generally known in the industry as recliners that have a width to accommodate one or more persons. The term "seat" is also intended to include motion upholstery. These motion upholstery items may include sofas or "sectionals" that are intended as multi-seat furniture pieces with separate portions capable of independent operation. For example, three or more of the seats 1 described in this disclosure may be arranged side-by-side and upholstered as a single piece of furniture with a plurality of independent seating sections. In another example, two of the seats 1 of this disclosure may sandwich a fixed section so that only the ends of a sofa are provided with a reclining function. In yet other embodiments, the fixed section(s) may be replaced with sleeper sections that are able to convert a segment of the furniture piece from a seating configuration to a bed configuration.

There are several types of connections described throughout this description. When elements are described as fixedly connected, substantially no relative motion is provided between the described elements. Fixed connections may be substantially permanent such as welding or may be more readily capable of assembly and disassembly with bolts, nails, screws or equivalent fasteners. Two items are often fixedly connected if attached at two or more separate locations. Several elements in this disclosure are described as pivotally connected. Pivot connections allow for rotation of one element relative to another element about a substantially fixed pivot point. Therefore, if the pivot point is able to move, the respective ends of the pivotally attached members will similarly move. Other connections are described herein as slidable connections. The slidable connections allow one element to translate relative to another along a path constrained by a groove, slot, or track. Sliding connections as used herein include both pure sliding of two surfaces passing each other as well as rolling connections where bushings, bearings, or rollers allow for translation of two surfaces past one another. Fixed connections, pivotal connection and sliding connections may also include respective indirect connection or relative connection. Therefore two elements may be fixed for purposes of motion but those elements may not be directly connected together.

According to some embodiments, the seat 1 may be characterized by having an upright, fully closed position where the presence of a headrest, a footrest, and the ability to recline the seat 1 while a headrest deploys, are all substantially hidden.

Embodiments of the seat 1 may allow for a movable back, where the rearmost portion of the seat is able to recline or otherwise move. In a preferred embodiment, the seat 1 is designed to portray a low, closed-back appearance. Particularly, the seat 1 may have a low overall height "A" from the floor to the top of the backrest cushion 2. In some embodiments the top of the backrest cushion 2 is above the height of the closed back 3. "Closed back" means that, when viewed from the rear, the back of the product is smooth, closed off, stationary, and fixed. In other words, the rearmost portion, e.g. an outside back shell, of the closed back embodiments of the seat 1 does not move. Preferably, the closed back 3 generates an appearance from the back where there are not seams or gaps between elements that would indicate the presence of separate movable parts. The closed back 3 may be defined by upholstery panels that form a cavity. The cavity may be formed by rear, top, and side panels all of which may be upholstered and without gaps and fixed relative to each other and to the floor. The cavity may house and hide or conceal a motion mechanism when the seat 1 is in the upright closed position. During reclining, all moving components remain forward of the closed back 3. Therefore a seat 1 with a closed back 3 may be classified as a zero wall clearance recliner, but not all zero clearance recliners will have closed backs 3. Ideally, the appearance of the seat 1, when seen from the rear, is not compromised, as is often the case with typical recliners and motion sofas, by various gaps necessary to allow parts to move backward or upward. Having the closed back 3 also means that the seat 1 may be positioned in the middle of a room with the back visible or that the back may be pushed against a wall. Often similar chairs and sofas must be positioned some distance from a wall in order to allow clearance for the reclining backrest to move rearward of its upright position.

The set of figures provided with this disclosure present a variety of views with each figure presented to a varying degree of assembly and disassembly. It should be understood that like parts have been given like numbers in each figure. For purposes of this disclosure, similar parts may be given the same reference number even though the parts may not be completely identical. For example, similar members of a set may be given the same number even though each member of the set is not identical in the illustrated embodiment. In another example, several elements of the seat 1 are provided as a symmetric construction with a paired left and right components which may be identical or mirror symmetric of each other. It will be apparent to one of ordinary skill in the art that given a fully illustrated component on one side, the structure and function of the opposite component will be understood.

FIG. 1 is a perspective view of an embodiment of a seat 1 according to the present disclosure. The seat 1 is shown in a fully closed position. The fully closed position is defined as the position where the backrest cushion 2 is fully upright, and an optional footrest 5 is closed. The seat 1 may also include a seat cushion 6. Cushions 2 and 6 may each be attached to underlying support members or may be loose and readily removable. The seat 1 of FIG. 1 is shown with a single upholstered arm 7. In other embodiments, the seat 1 may include a pair of upholstered arms. In yet other embodiments, the seat 1 may form the middle section of a sofa, or may not have an upholstered arm on one or both sides.

In an embodiment, seat 1 has a low profile such that the height "A" from the top of the backrest cushion 2 to the floor is relatively low. Further, the backrest cushion 2 may have a height H that is relatively short, terminating below the head of a seated user of average height. Thus, when reclined, the backrest cushion 2 may not be sufficiently tall to support the head of the user in a comfortable position. It is noted that when the user is sitting in an upright position, i.e., when the seat 1 is fully closed, it is not expected that head support will be necessary, and a backrest cushion 2 that terminates below the head will be sufficient.

Figure 2:
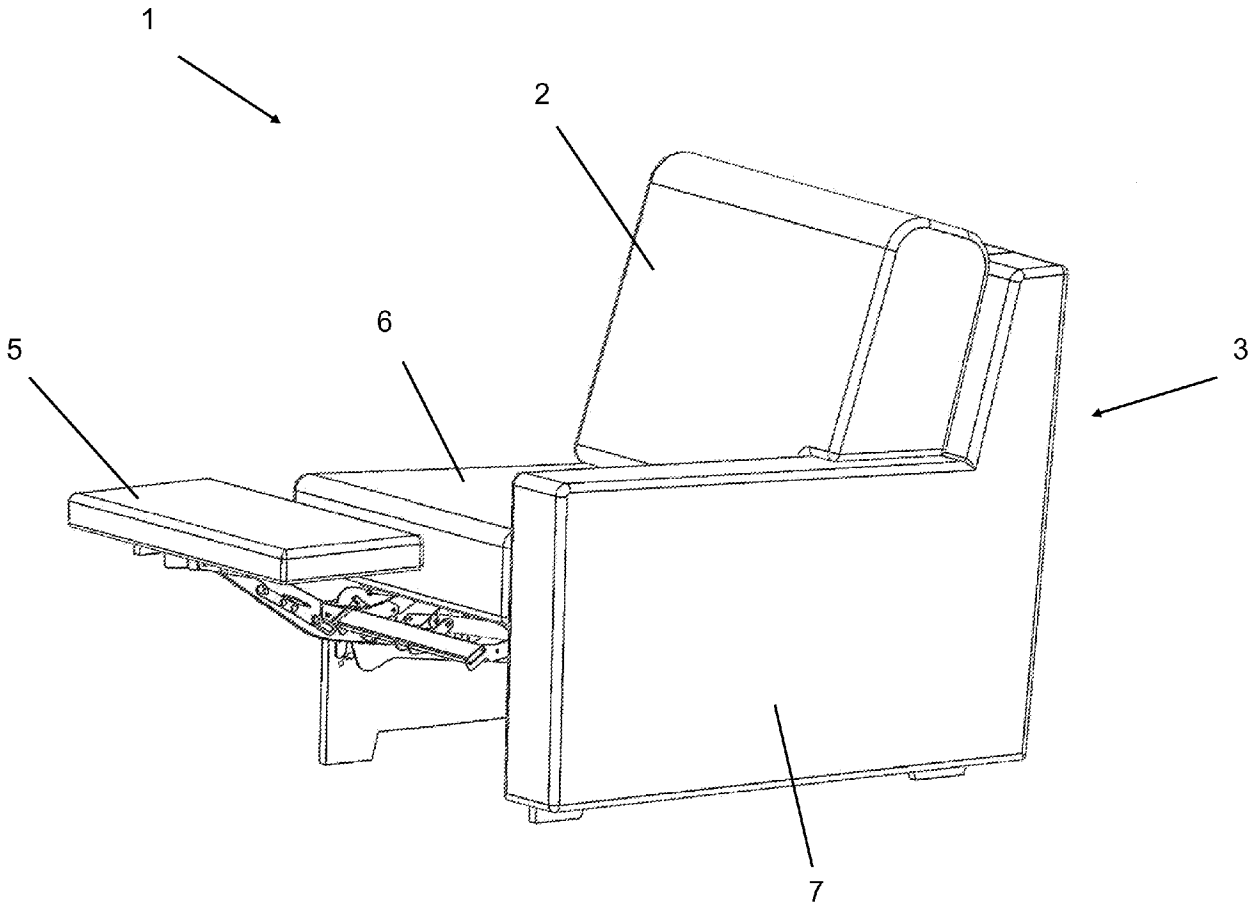
FIG. 2 shows a perspective view of the seat with the footrest open and the backrest upright.

FIG. 2 shows seat 1 with the footrest 5 open and the backrest cushion 2 fully upright. The position shown in FIG. 2 may be referred to as the "TV" position. Users may feel that the TV position, with the footrest 5 open and the backrest cushion 2 upright, is an ideal position to comfortably watch TV.

Figure 3:
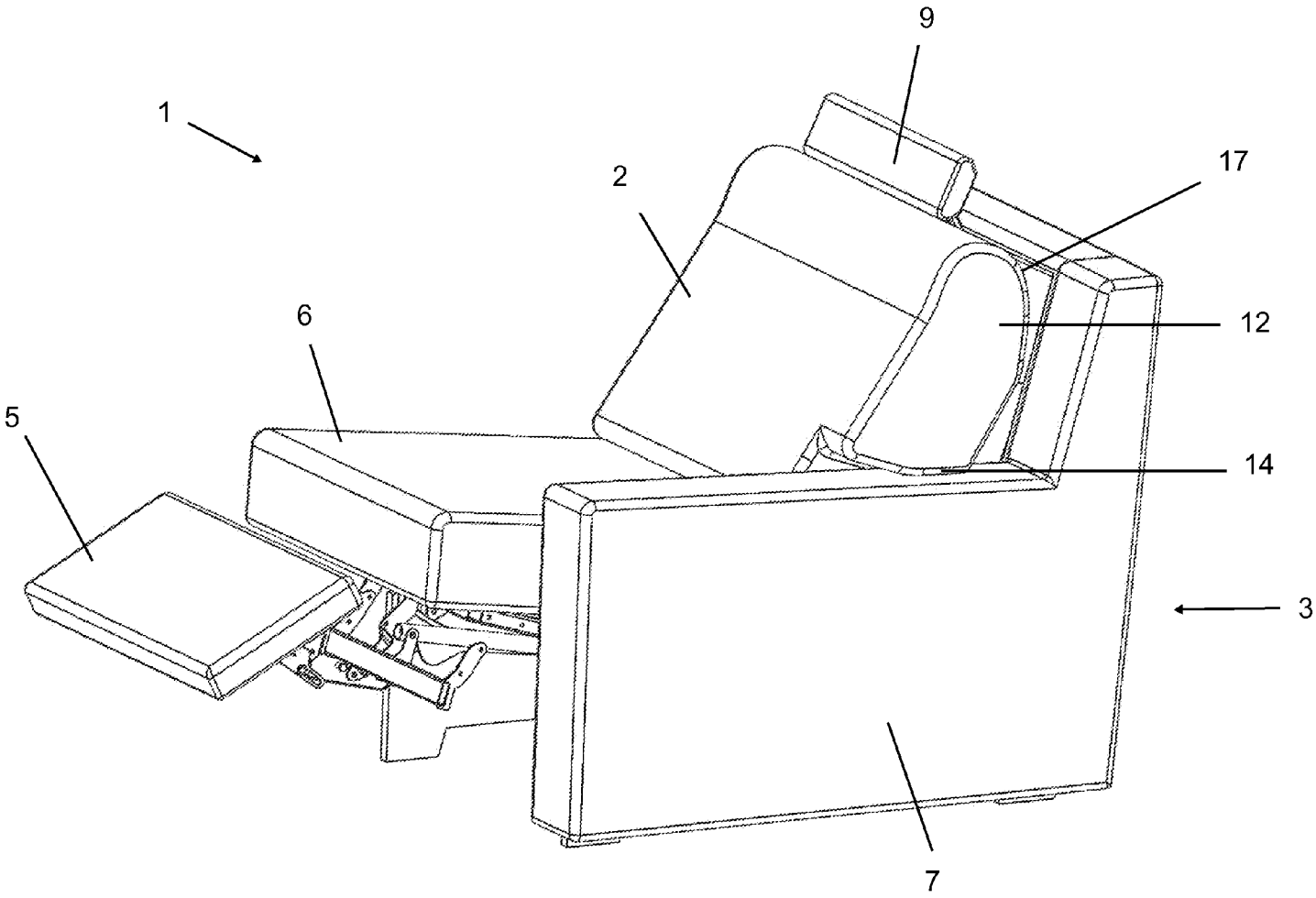
FIG. 3 shows a perspective view of the seat with the footrest partially open and the backrest reclined with the headrest up.

FIG. 3 shows the seat 1 with a footrest 5 partially open and the backrest cushion 2 fully reclined. At least when the backrest cushion 2 is fully reclined, a headrest 9 may be fully deployed adjacent to the top of the backrest cushion 2. In one embodiment, the headrest 9 is upholstered. As understood by comparison of the backrest cushion 2 in FIGS. 2 and 3, the backrest cushion 2 may be configured to be compressible when disposed in the reclined position. For example, as shown in FIG. 3, the ear portion 12 of the backrest cushion 2 that extends over the upholstered arm 7 is shown compressed at its lower edge 14 by contact with the top of the upholstered arm 7. In some embodiments, the ear portion 12 may be omitted, or the ear portion 12 may be configured such that the lower edge 14 is not compressed when the backrest cushion 2 reclines. The top rear portion 17 of backrest cushion 2 is also shown in a compressed state due to contact with the headrest 9. In other embodiments, the headrest 9 may be positioned clear of the backrest cushion 2 to avoid compression of the top rear portion 17.

In the illustrated embodiment, the backrest cushion 2 is shifted in a forward direction away from the closed back 3 as the backrest cushion 2 reclines. This forward displacement allows the backrest cushion 2 to recline without striking the closed back 3. As also seen in FIG. 3, the seat cushion 6 is also shifted forward, shown extending beyond the front of the arm 7, when the backrest cushion 2 is reclined.

Figure 4:
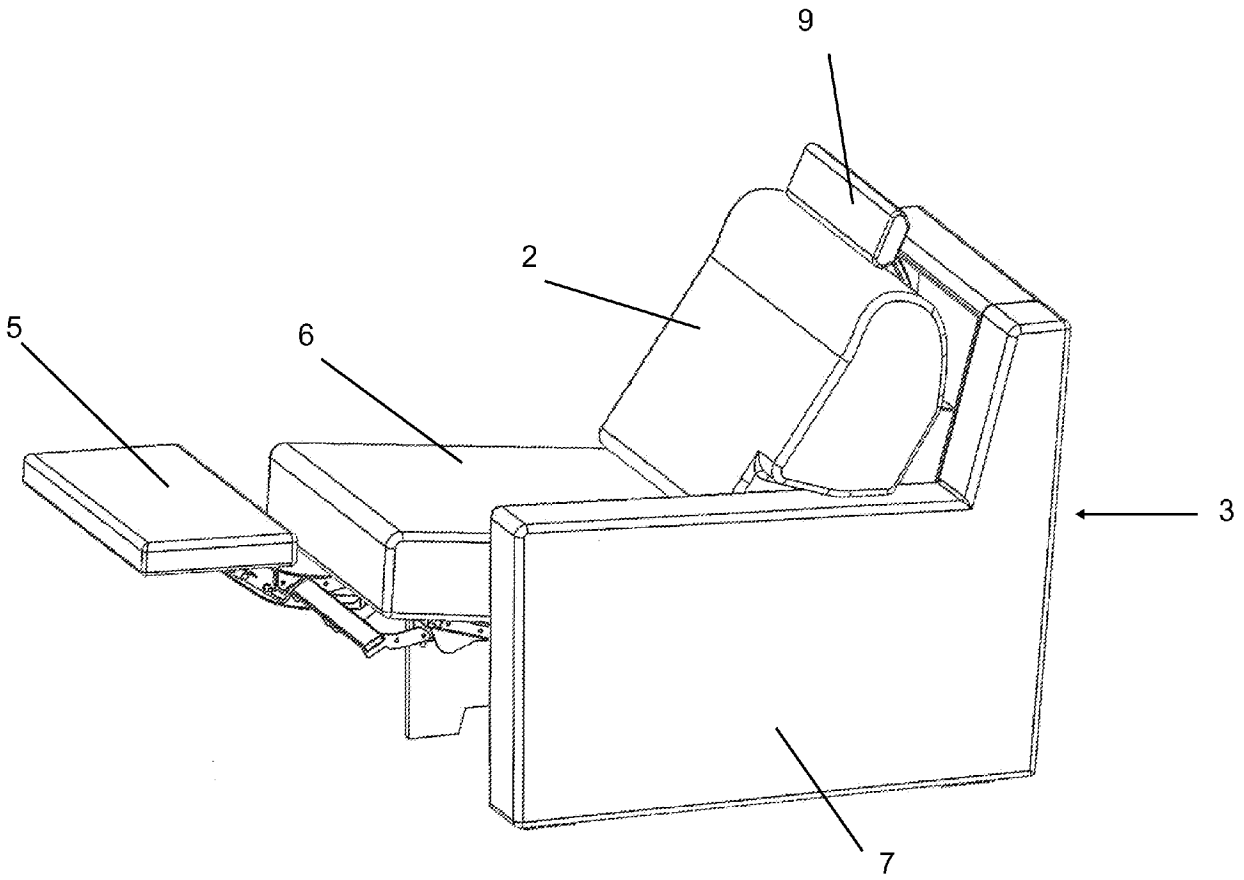
FIG. 4 shows a perspective view of the seat with the footrest up and the backrest fully reclined with the headrest up.

FIG. 4 shows a perspective view of the seat 1 in a fully open position. In the fully open position, the footrest 5 is open and the backrest cushion 2 is fully reclined with the headrest 9 fully deployed.

Figure 5:
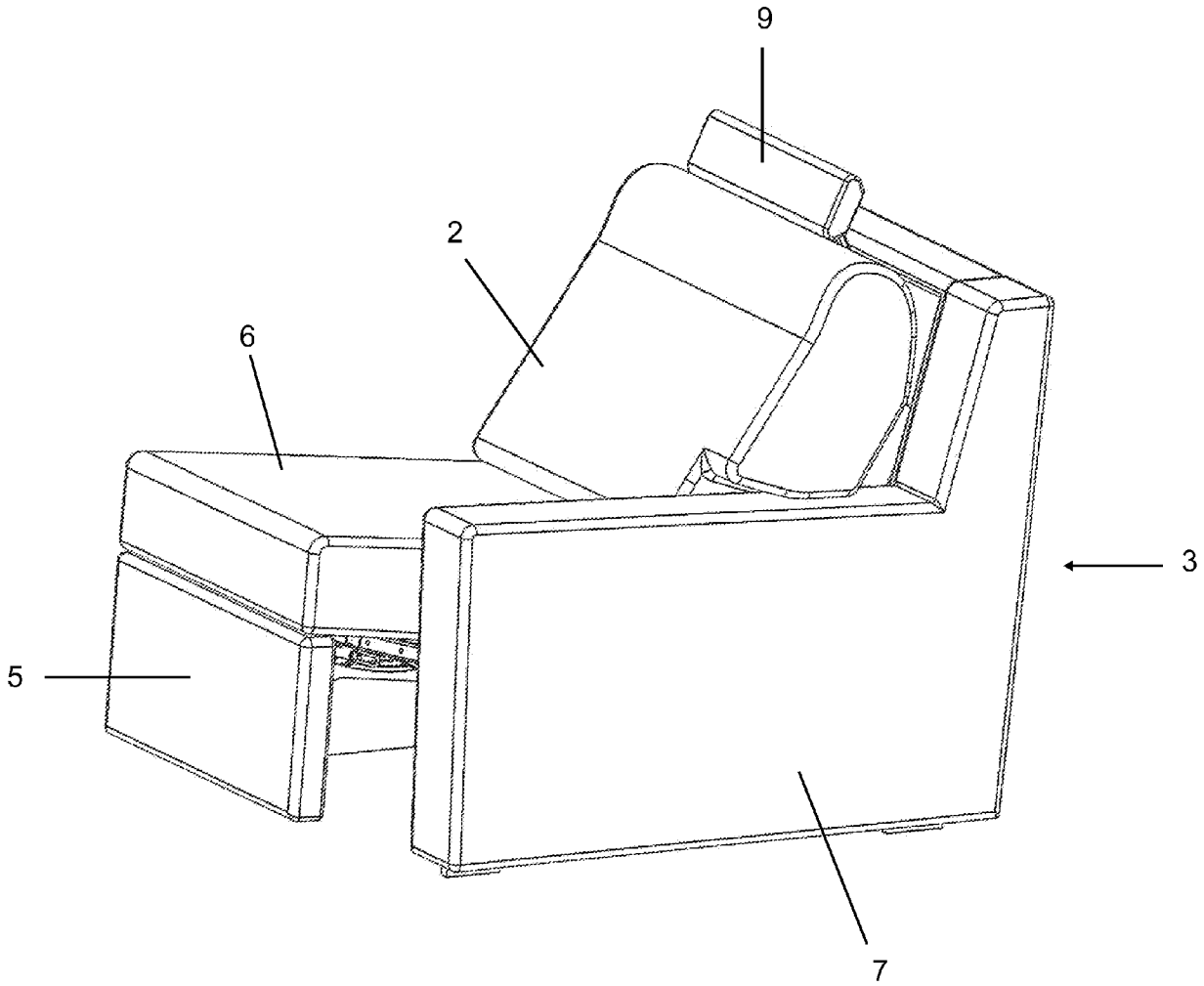
FIG. 5 shows a perspective view of the seat with the footrest closed and the backrest reclined with the headrest up.

FIG. 5 shows yet another possible position of the seat 1. FIG. 5 shows the footrest 5 closed while the backrest cushion 2 is reclined. The headrest 9 is shown in the deployed position. As will be discussed below, in several embodiments, the headrest 9 is configured to deploy while the backrest cushion 2 is being reclined. In some embodiments, however, the headrest 9 may be deployed independently of the backrest cushion's motion. For example an electric motor may be provided to independently deploy and adjust the headrest 9. Control logic could be provided to prevent deployment of the headrest 9 if a sufficient gap around the closed back 3 is unavailable. In most embodiments, it will be appreciated that the closed back 3 and backrest cushion 2 combine to hide the presence of the headrest 9 when the backrest cushion 2 is upright.

As should be understood from FIGS. 3-5, the footrest 5 can be moved to a potentially infinite number of positions from fully closed as seen in FIG. 5 to fully open as seen in FIG. 4. In other words, the footrest assembly (see FIG. 16, discussed below) may be configured to allow the footrest 5 to stop at a potentially infinite number of intermediate positions between fully closed and fully open. FIG. 5 suggests that the footrest 5 may be capable of changing position independent of the position of the backrest cushion 2. In other embodiments, it may be possible to synchronize or even require that the footrest 5 opens as the backrest cushion 2 reclines.

Figure 6:
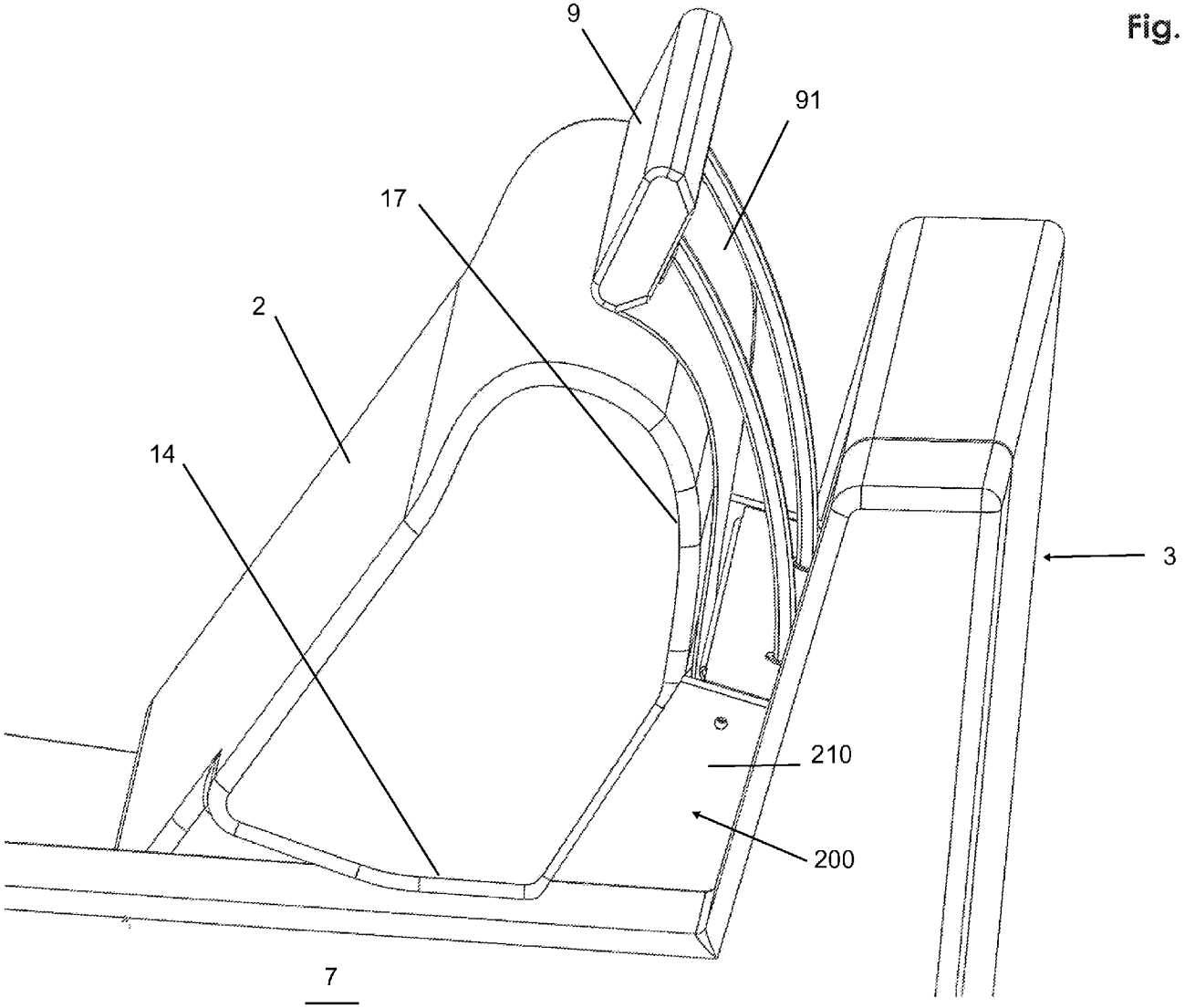
FIG. 6 shows an enlarged perspective view of details of the backrest and headrest of the seat with the backrest reclined and with the headrest up.

FIG. 6 shows an enlarged partial rear perspective view of the seat 1 in the position of FIG. 5. Note that headrest 9 is shown with a flap 91 attached to the lower portion of the headrest 9 and extending downward therefrom. The flap 91 is configured to be pulled up as the headrest 9 deploys, and to return as the headrest 9 retracts.

The backrest cushion 2 is supported by a motion mechanism 100 (see FIG. 8) that may include a backrest frame 200. The backrest frame 200 can include a pair of side panels 210. The backrest frame 200 is provided for movement relative to the optional upholstered arm 7 and the closed back 3.

Figure 7:
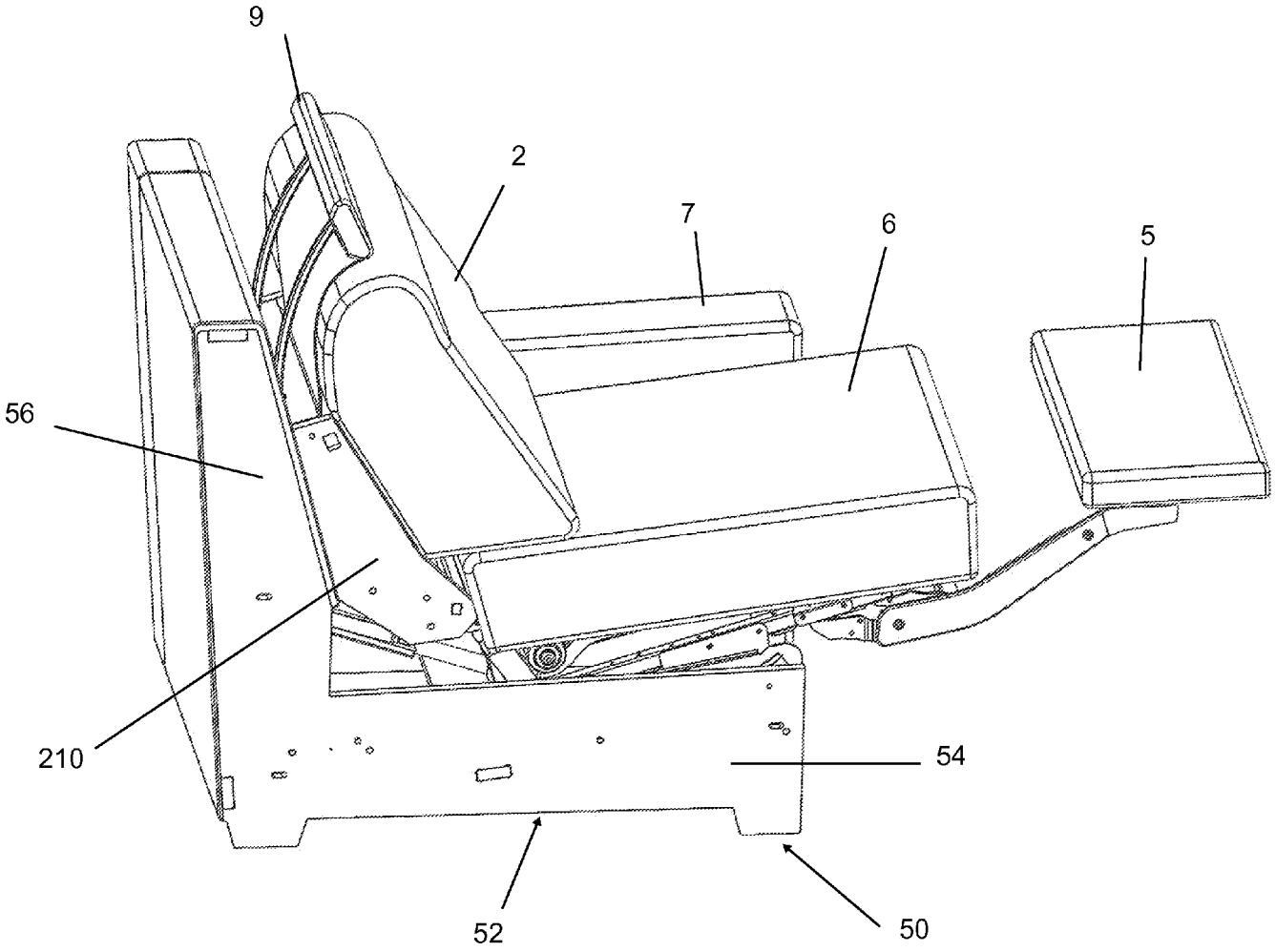
FIG. 7 shows another inside perspective view of the seat with the footrest up and the backrest reclined with the headrest up.
Figure 8:
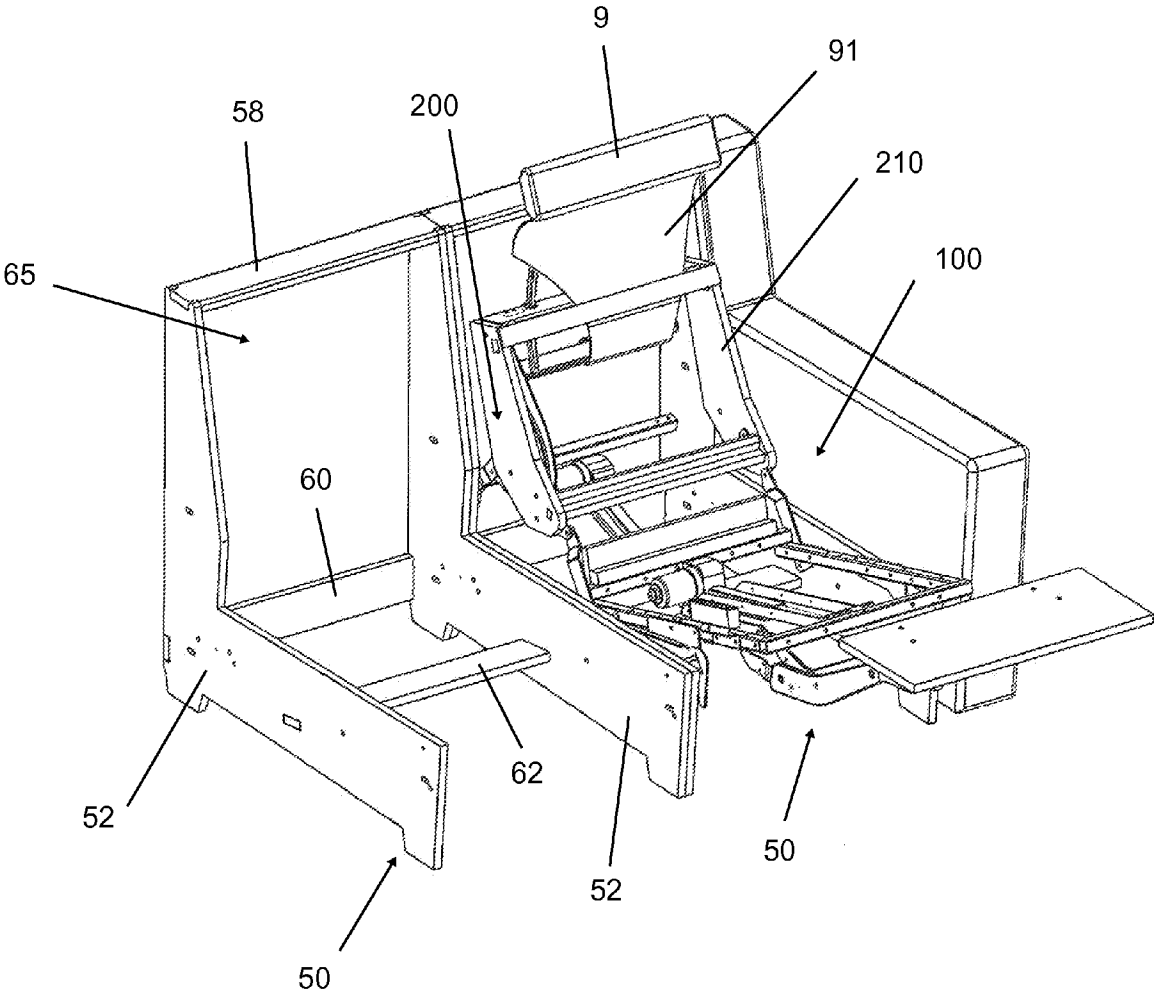
FIG. 8 shows portions of a seat of the present disclosure attached to an adjacent frame for forming a multi-seat sofa.
Figure 9:
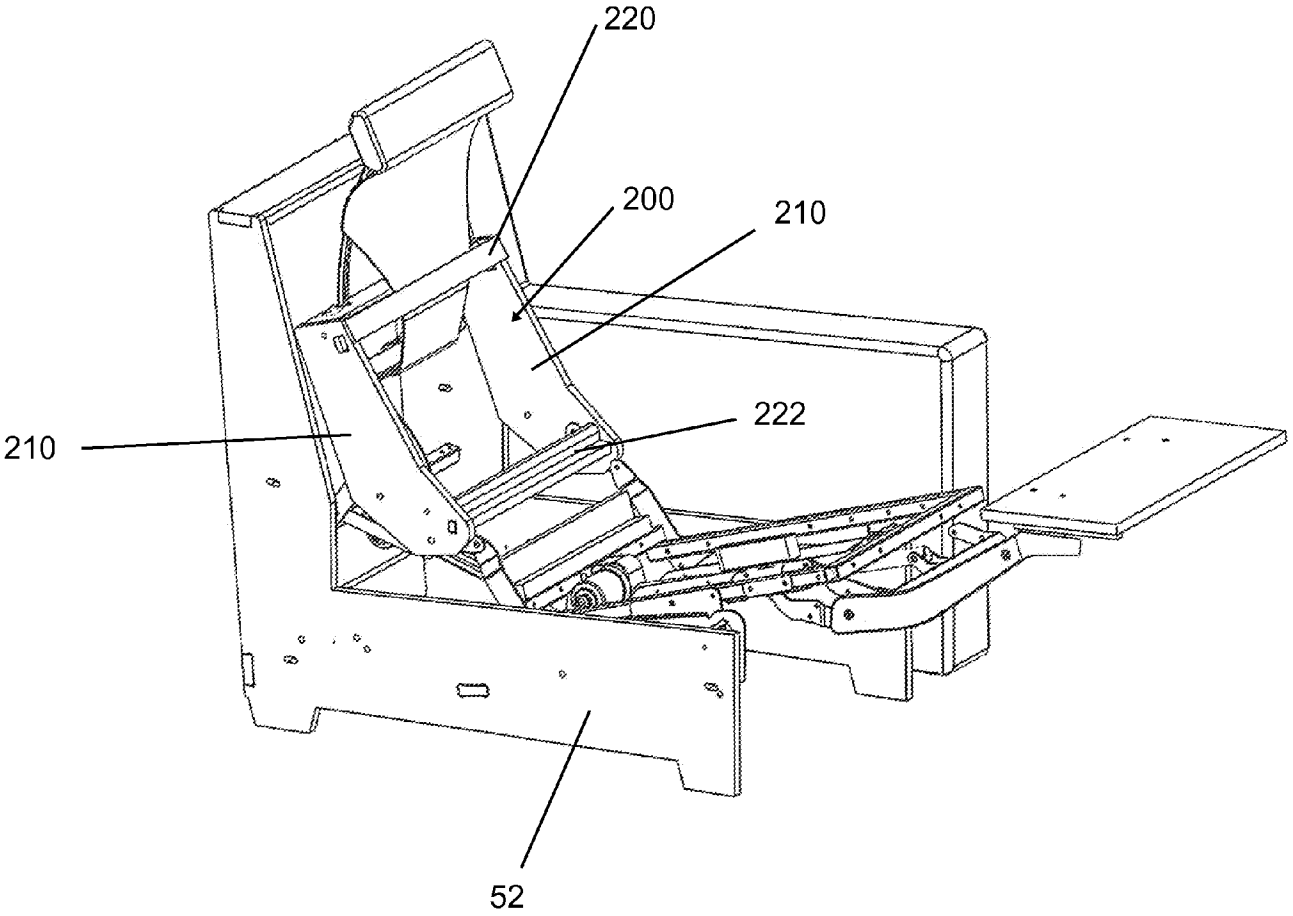
FIG. 9 shows a perspective view of elements of the seat with the footrest up and the backrest reclined with the headrest up and showing an un-upholstered fixed frame panel which may be attached to an adjacent similar panel to construct a multi-seat sofa.

The structure of the seat 1 will become more apparent in view of FIGS. 7-9 which show the seat 1 in varying degrees of completion. FIG. 7 shows the seat 1 in the fully open position after one of the upholstered arms 7 has been removed. Removing the upholstered arm 7 reveals a portion of the stationary support frame 50, particularly an upright panel 52. The upholstered arm 7 could be bolted or otherwise attached to a respective upright panel 52. The support frame 50 provides the stationary support structure of the seat 1. The support frame 50 includes at least a pair of upright panels 52. In the illustrated embodiment, the upright panel 52 includes a seat portion 54 and a back portion 56. In some embodiments, the seat portion 54 and the back portion 56 may be provided by separate panels that can be assembled together.

As best seen in FIG. 8, the support frame 50 may include one or more cross members, such as top cross member 58, rear cross member 60 and bottom cross member 62. One or more of the cross members 58, 60, 62 may provide proper spacing between each set of upright panels 52. One or more of the cross members 58, 60, 62 may add to the structural rigidity and stability of the seat 1. The top cross member 58 may be provided to define the upper wall of the support frame 50. Particularly, a cavity 65 may be defined below the top cross member 58 and between a pair of upright panels 52. In other words, the cavity has a closed, and stationary, top due to the top cross member 58. The rear edges of the upright panels 52 may be connected by upholstery to provide a closed back 3 substantially free from gaps. The backrest frame 200 is able to reside substantially within the cavity 65 when in the upright position. In some embodiment, the backrest cushion 2 is sized to close off the opening to the cavity 65 when in the upright position as seen in FIG. 1. Therefore the closed off opening presents an appearance of a seat 1 substantially free from gaps into the cavity 65, when viewed from the front, top, or side. As such, the seat 1 appears as though it does not have the ability to recline or the ability to provide a headrest 9 when the seat 1 is in the fully closed position.

In the illustrated embodiment of FIG. 8, a pair of support frames 50 are disposed side by side. Additional support frames 50 can be similarly provided to increase the capacity of the seat 1. The support frames 50 can be bolted or otherwise joined together through opposite upright panels 52. In FIG. 8, only one of the two support frames 50 is shown with a motion mechanism 100 installed. In this way, the motion mechanism 100 may be considered as a modular unit that may be selectively included in a given support frame 50. In some embodiments a completed product may include a motion mechanism 100 within each support frame 50. In some embodiments a completed product may include a motion mechanism 100 within select support frames 50 of a plurality thereof. In other embodiments, only a single support frame 50 is provided for the seat 1.

FIGS. 8 and 9 more clearly illustrate the backrest frame 200. The backrest frame 200 includes a pair of side panels 210. Upper and lower horizontal members 220, 222 may reinforce the connection between the side panels 210. Webbing (not shown) may be attached between forward edges of the side panels 210 to provide an elastic support surface for the backrest cushion 2. The backrest frame 200 may be constructed of wood members that readily accept webbing and upholstery. Therefore, the backrest frame 200 may also assist with obstructing moving linkages from view and providing the seat 1 with a pleasing profile in the reclined position.

Figure 10:
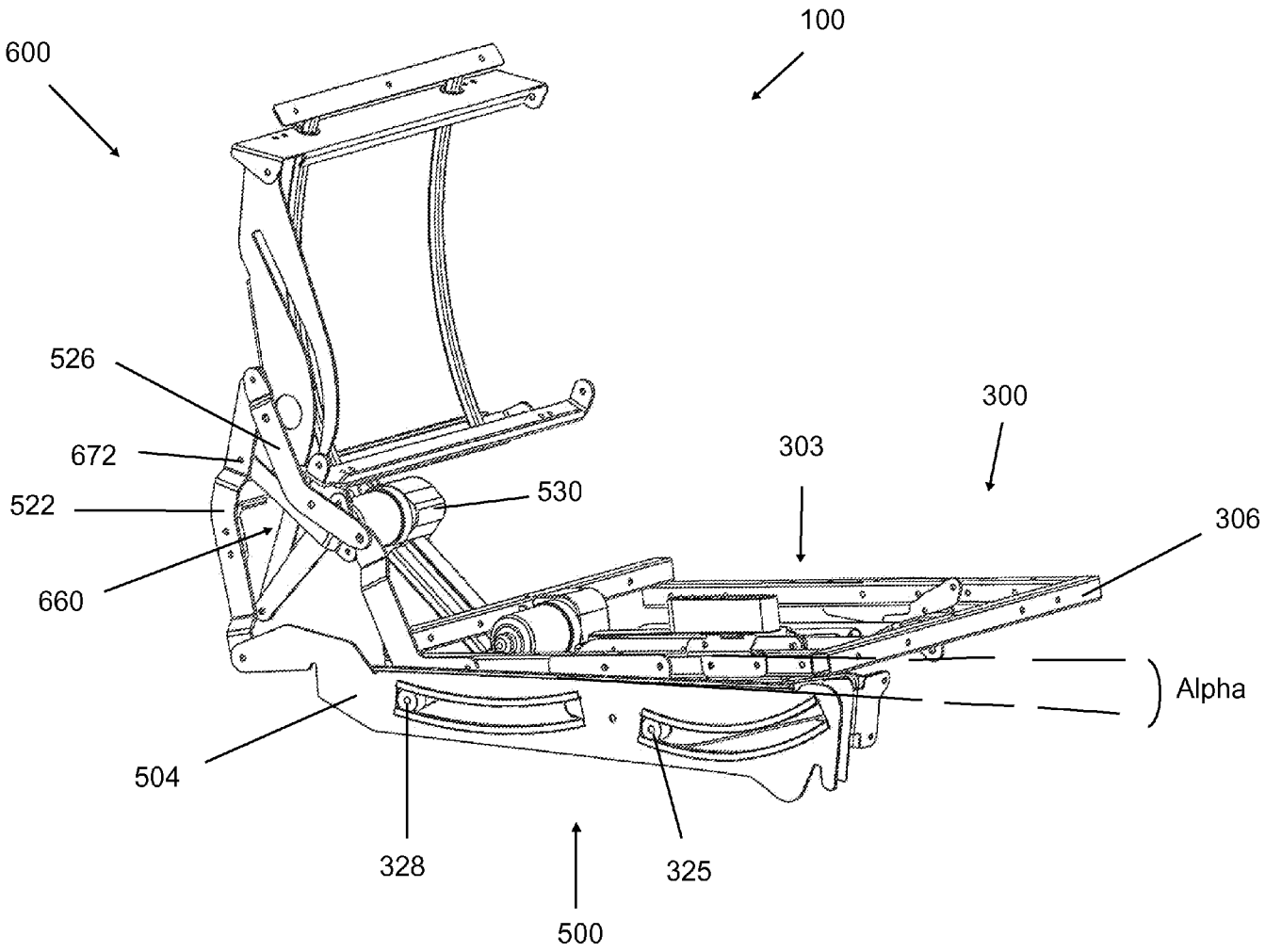
FIG. 10 shows a partial perspective view of the motion mechanism of the seat with the backrest upright and the footrest closed.
Figure 11:
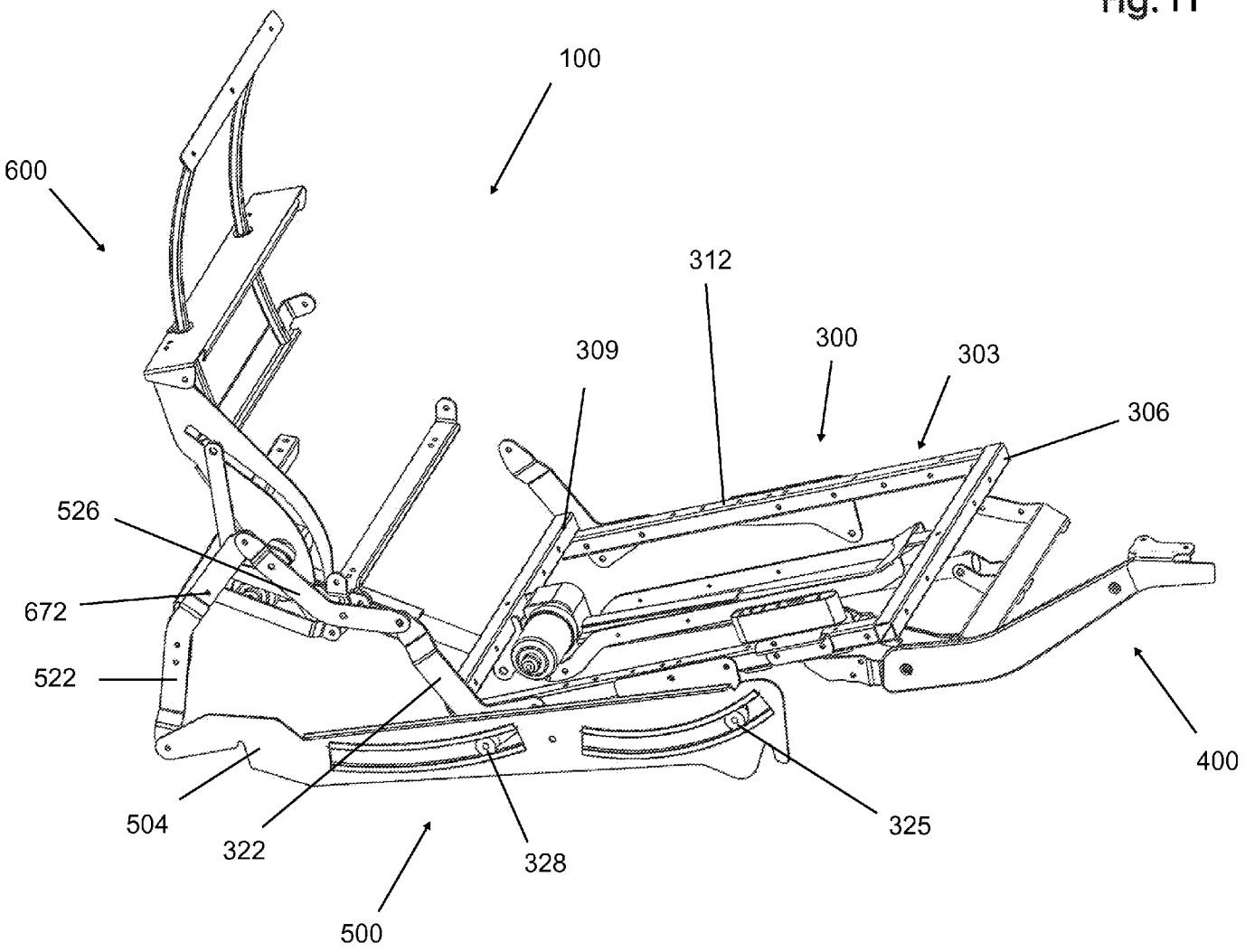
FIG. 11 shows a partial perspective view of a motion mechanism of the seat of the present disclosure with the backrest reclined and the footrest open.

FIGS. 10-13 show further combinations of included and omitted elements to assist with understanding the structure and function of embodiments of the present disclosure. FIGS. 10 and 11 show a motion mechanism 100 with the backrest frame omitted. For clarity, several elements are also omitted where left and right components are identical or mirror opposites to one another. The motion mechanism 100 may be generally described in terms of a seat assembly 300, a footrest assembly 400, a recline assembly 500 and a headrest assembly 600. The seat, recline and headrest assemblies 300, 500 and 600 are each designed in close connection with each other to produce an operable motion mechanism 100 with carefully timed movement of each component.

Seat Assembly

Figure 12:
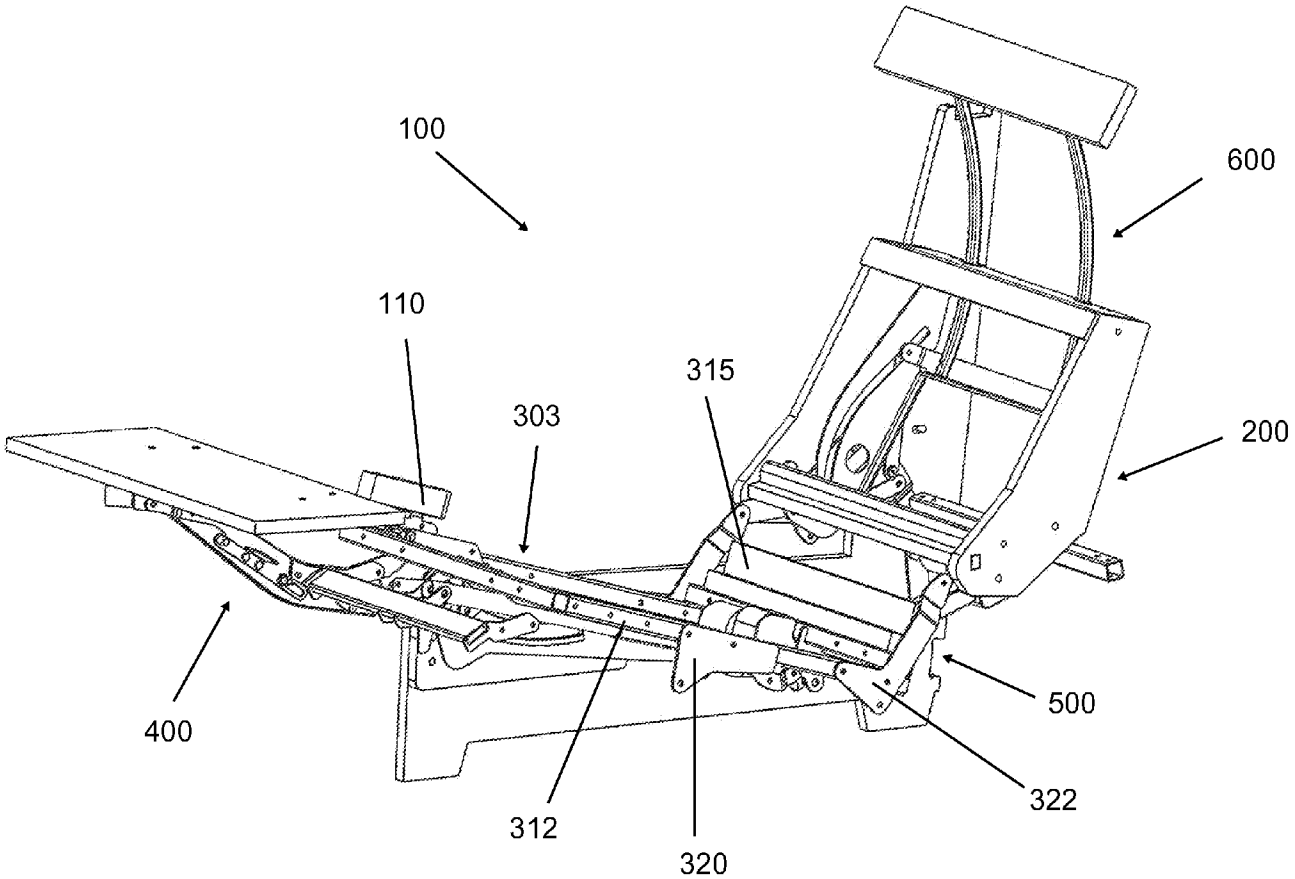
FIG. 12 shows a perspective view of the seat with the arm and a portion of the support frame removed.
Figure 13:
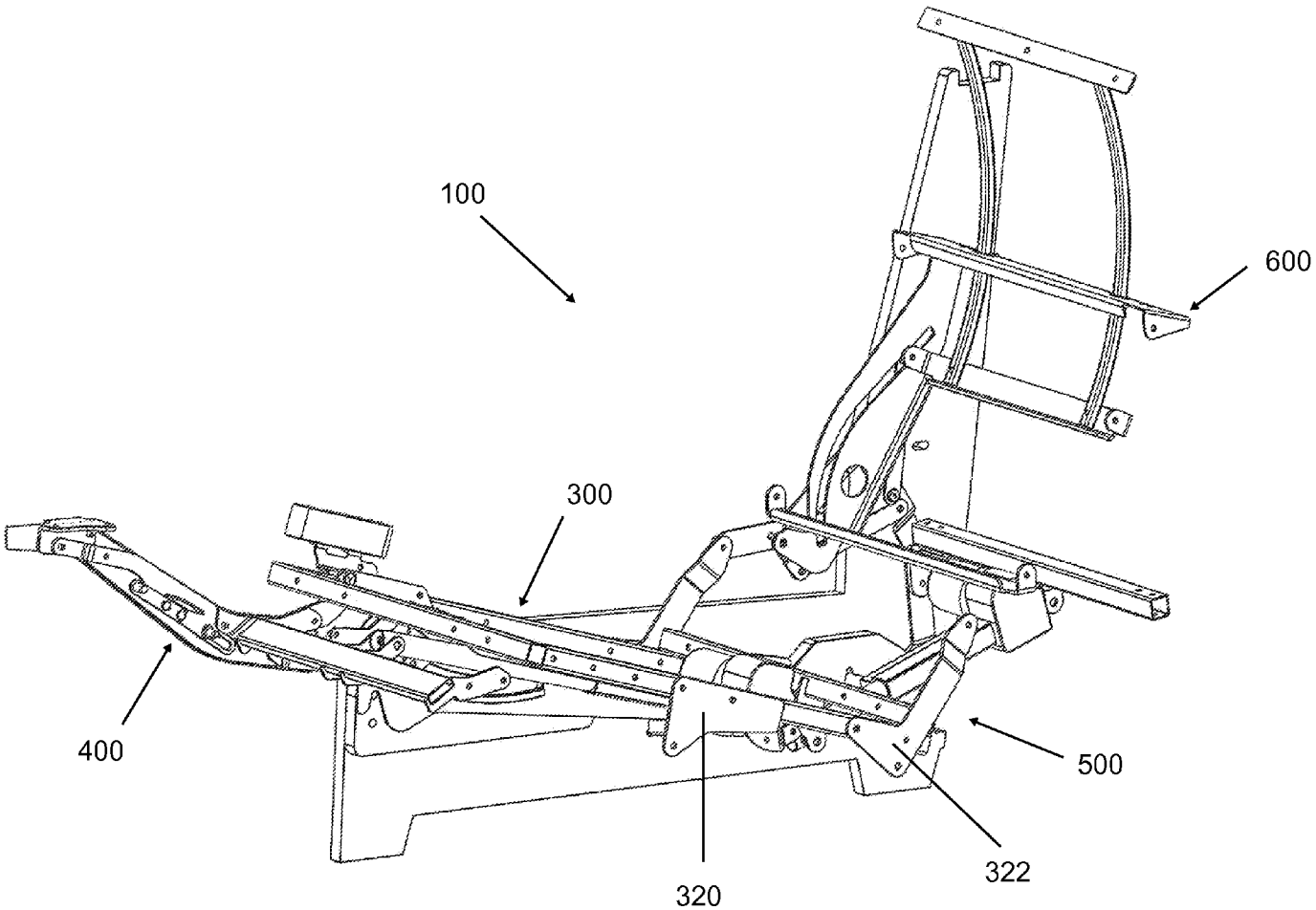
FIG. 13 shows a perspective view of the seat with additional elements omitted.

The seat assembly 300 includes the seatbox 303 comprised of a front tube 306, a back tube 309, and a pair of side tubes 312, as best understood with respect to FIG. 11. The seatbox 303 functions to support the seat cushion 6. As best seen in FIG. 12, a rear member 315 may be attached as part of the seatbox 303 for supporting the rear end of the seat cushion 6. Webbing (not shown) may be provided over the seatbox 303 to provide an elastic support for the seat cushion 6.

As best seen in FIG. 12, the side tubes 312 may be each fitted with a forward seatbox mounting plate 320 and a rearward seatbox mounting plate 322. A first bushing 325 (FIG. 11) is attached to the forward seatbox mounting plate 320. A second bushing 328 is attached to each rearward seatbox mounting plate 322. As used herein the term "bushing" is used generically to include low friction slides, projections, bearings, rollers or equivalent structures.

The first and second bushings 325, 328 may be configured to include a flanged bushing and a spacer washer such that they are constrained within their respective travel slots discussed below.

Footrest Assembly

Figure 14:
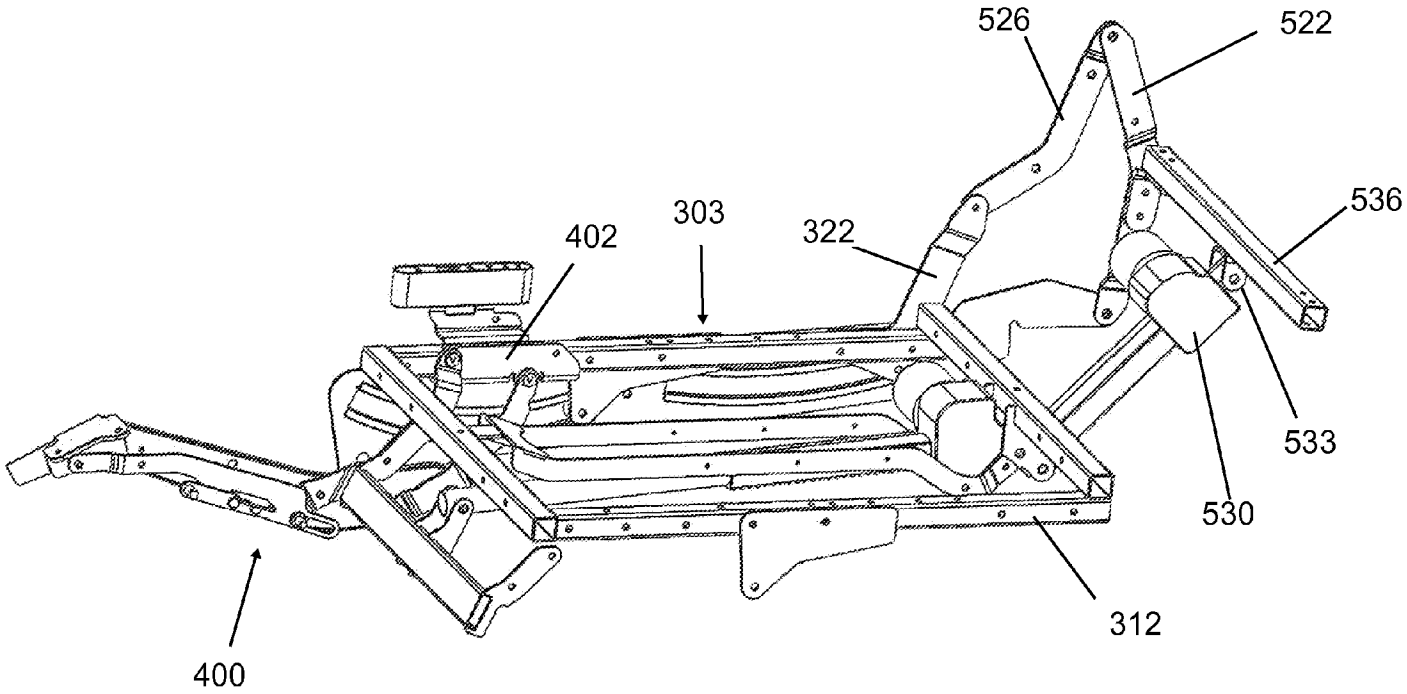
FIG. 14 shows a partial top perspective view of the motion mechanism with the footrest partially open, the backrest upright, and the headrest assembly substantially removed.
Figure 15:
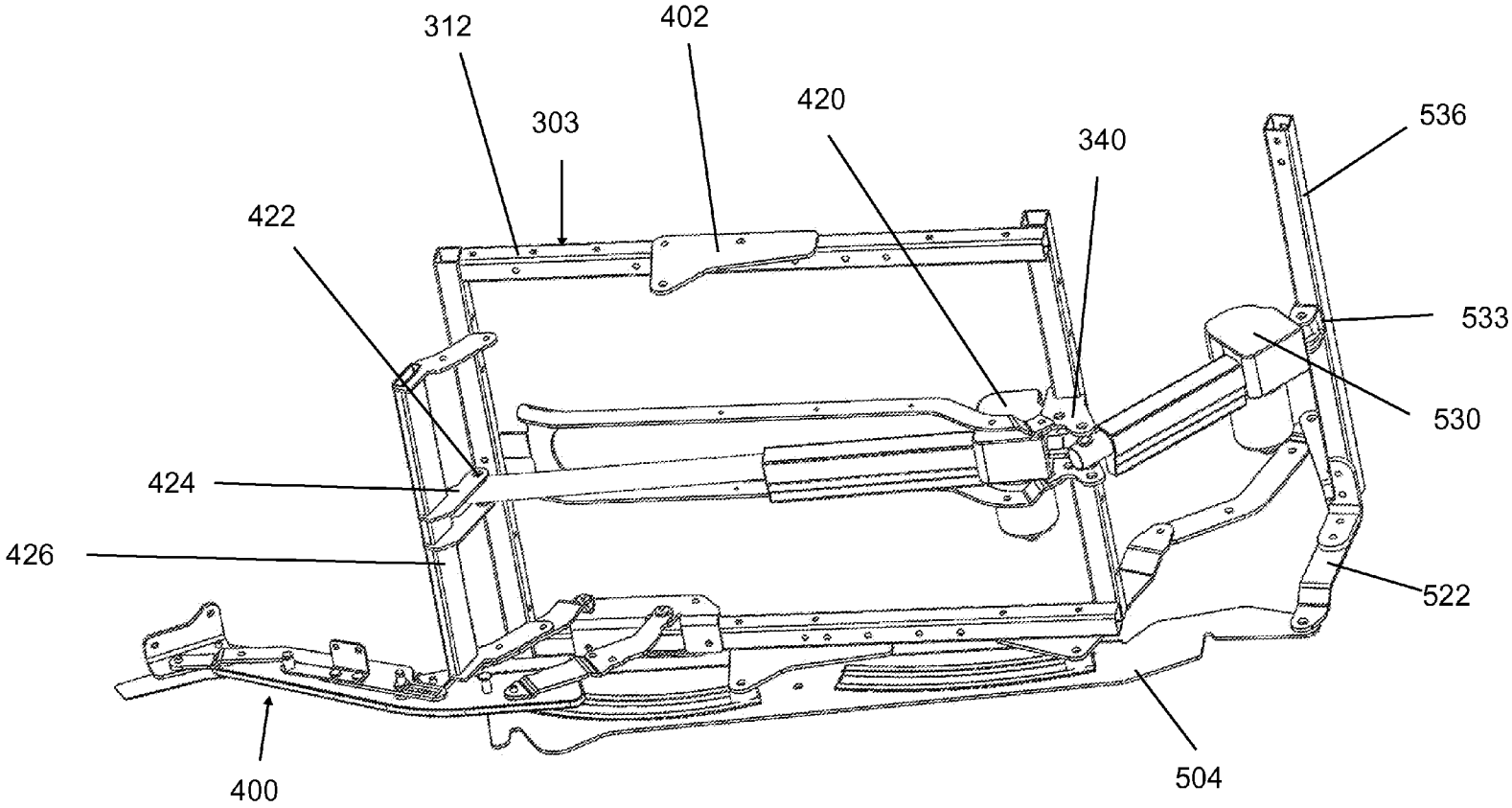
FIG. 15 shows a partial bottom perspective view of the motion mechanism with the footrest partially up, the backrest upright, and the headrest assembly substantially removed.
Figure 16:
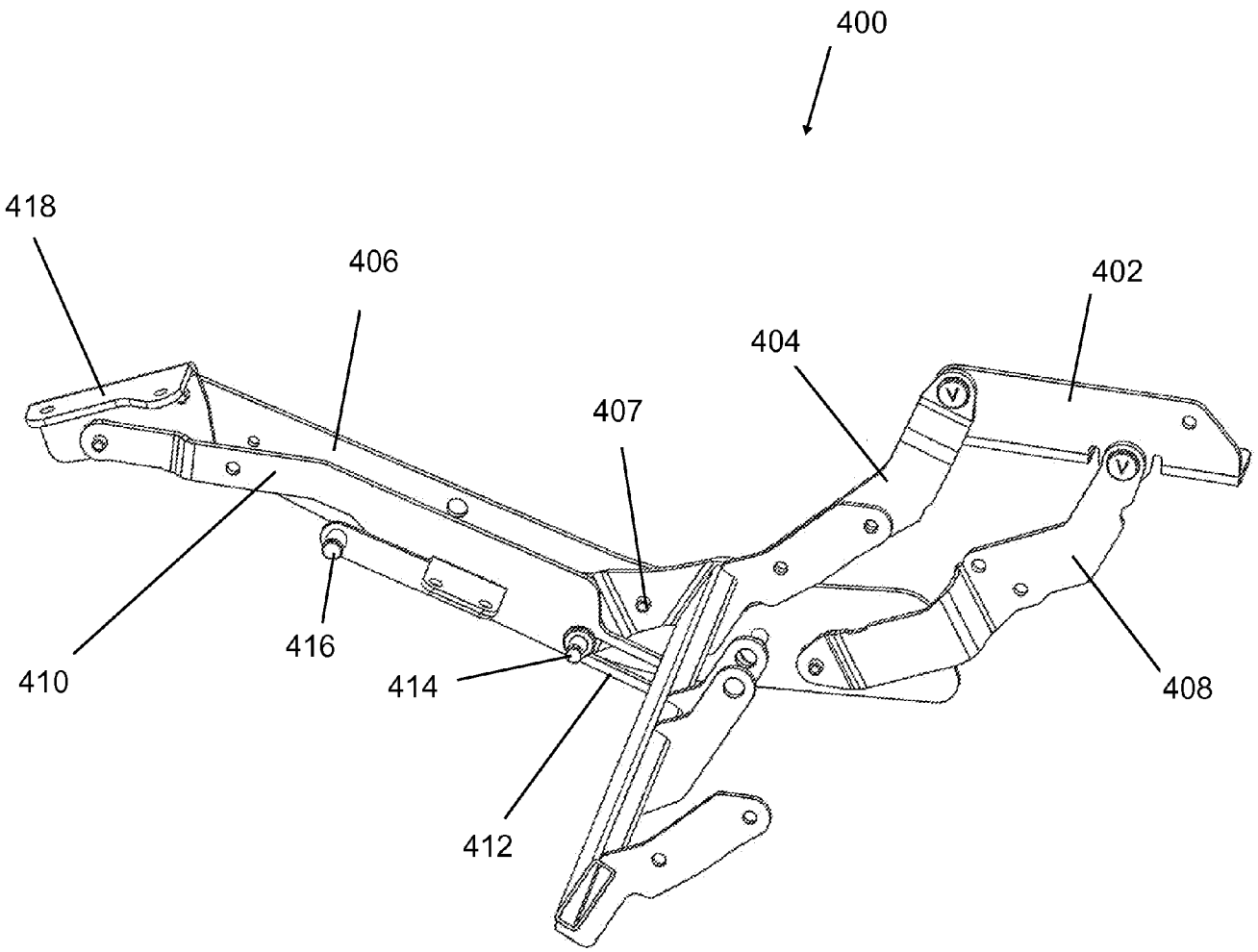
FIG. 16 shows a partial inside perspective view of the footrest assembly.

The footrest assembly 400 is best understood in view of FIGS. 14-16. FIG. 16 shows an inside perspective view of the footrest assembly 400. An attachment plate 402 of the footrest assembly 400 is bolted or otherwise mounted to the seatbox 303, such as side tube 312 as seen in FIG. 15. A forward swing link 404 is pivotally attached at its top end to attachment plate 402, and is pivotally attached at a lower end to a main footrest link 406 at pivot 407. A rear swing link 408 is pivotally connected at its top end to the attachment plate 402, and is pivotally attached at a lower end to the main footrest link 406. An auxiliary link 410 is pivotally connected to the main footrest link 406 with an elongated hole 412 such that the auxiliary link 410 can slide forward relative to a spring pin 414 to the location where the spring pin 414 is at the rear of the elongated hole 412. The spring pin 414 is fixed to a lower portion of the forward swing link 404. A spring (not shown) is connected between a boss 416 and the spring pin 414 such that the auxiliary link 410 is biased backward. The forward end of the auxiliary link 410 is pivotally connected to a footrest bracket 418 such that when forward and rear swing links 404 and 408 are swung to the rear, the footrest assembly 400 is closed.

Footrest bracket 418 is pivotally connected to the main footrest link 406 as well as the auxiliary link 410. The footrest bracket 418 may directly support the footrest 5 or may indirectly support the footrest 5 through an additional structural member extending between the pair of footrest brackets 418 that are provided on the respective right and left sides of the motion mechanism 100.

Returning to FIG. 15, a footrest motor 420 may be provided for opening and closing the footrest assembly 400. A rear end of the footrest motor 420 is pivotally connected relative to a rear of the seatbox 303. In other words, the rear end of the footrest motor 420 pivots with respect to fixtures 340 mounted to the back tube 309. The forward end of the footrest motor 420 is pivotally connected at a first pivot point 422 to an extension 424 of a drive bar 426 that is extends between opposite forward swing links 404. The drive bar 426 may be directly or indirectly fixed to each forward swing link 404. Extending footrest motor 420 causes footrest 5 to open and move upward.

Due to the elongated hole 412 and the spring stretched between the spring pin 414 and the boss 416, when the footrest motor 420 is closing, the footrest assembly 400 is spring loaded such that the footrest 5 is urged to a closed position by the force provided by the spring. In the event of an obstruction between, for example, the forward edge of the arm 7 and a back surface of the footrest 5, the footrest motor 420 may continue to move to a fully compressed position, but the footrest 5 can remain in a slightly open position in opposition to a minimum force provided by the spring. In effect, the spring provides resiliency into the motion of the footrest assembly 400.

Recline Assembly

Figure 17:
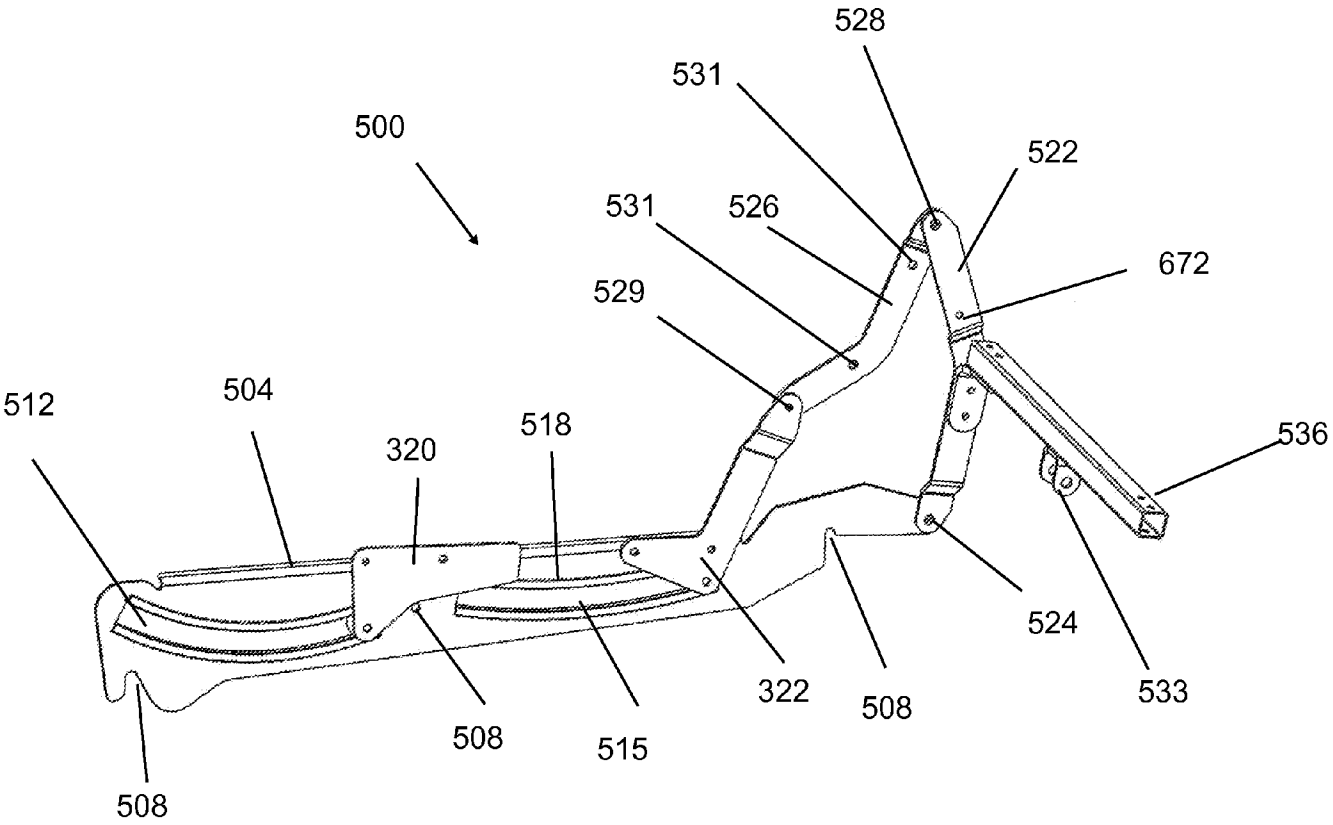
FIG. 17 shows a partial inside perspective view of the recline assembly.

The elements of the recline assembly 500 may be best understood in view of FIGS. 10, 11, and 17. The recline assembly 500 will now be described in terms of one side thereof. One skilled in the art will understand when separate left and right components should be provided to complete the recline assembly 500. The recline assembly 500 includes a mounting plate 504. The mounting plate 504 is used to attach the recline assembly 500, and therefore the motion mechanism 100, to the support frame 50. The mounting plates 504 may be provided with a plurality of mounting locations 508 in the form of apertures or grooves where the mounting plate 504 may be fixedly attached to the support frame 50, e.g. upright panels 52, with bolts, screws, nails or other fasteners.

The mounting plate 504 may include a front slot 512 configured to receive a first bushing 325 of the seat assembly 300. The mounting plate 504 may also include a rear slot 515 configured to receive a second bushing 328 of the seat assembly 300. As the first and second bushings 325, 328 slide, roll, or otherwise translate within the respective front and rear slots 512, 515, the seat assembly 300 is able to move relative to the support frame 50 as best shown when comparing FIGS. 10 and 11. Plastic glide tracks 518 may be provided around some or all of the internal perimeter of the front and rear slots 512, 515 in order to reduce the friction between the mounting plate 504 and the first and second bushings 325, 328.

In one embodiment, the front and rear slots 512, 515 are curved. Preferably, the radius of curvature of the front slot 512 is less than the radius of curvature of the rear slot 515. In this embodiment, as the seatbox 303 moves forward, the angle Alpha (FIG. 10) between the seatbox 303 and top edge of the mounting plate 504 increases, thereby elevating the front of the seat cushion 6 relative to the back thereof as the backrest cushion 2 reclines. A user is typically more comfortable when the front of the seat cushion 6 elevates as the backrest cushion 2 reclines. In some embodiments, the rear portion of the rear slot 515 is substantially tangent to a horizontal line parallel with the floor, such that forward movement of second bushing 328 causes the rearward seatbox mounting plate 322 to move forward and then increasingly upward as it moves forward. The illustrated embodiment may help to prevent excessive compression of the backrest cushion 2 against the arm 7 at the lower edge 14 when the backrest cushion 2 is fully reclined.

As best seen in FIG. 17, the recline assembly 500 includes a rear swing arm 522. The lower end of the rear swing arm 522 is pivotally connected to a rear end of the mounting plate 504 at a second pivot point 524. The upper end of the rear swing arm 522 is pivotally connected to a rear end of a connecting arm 526 at a third pivot point 528. The forward end of the connecting arm 526 is pivotally connected to the rearward seatbox mounting plate 322 at a fourth pivot point 529. The fourth pivot point 529 is positioned below the third pivot point 528 so that the connecting arm 526 is generally tilted rearwardly.

Figure 18:
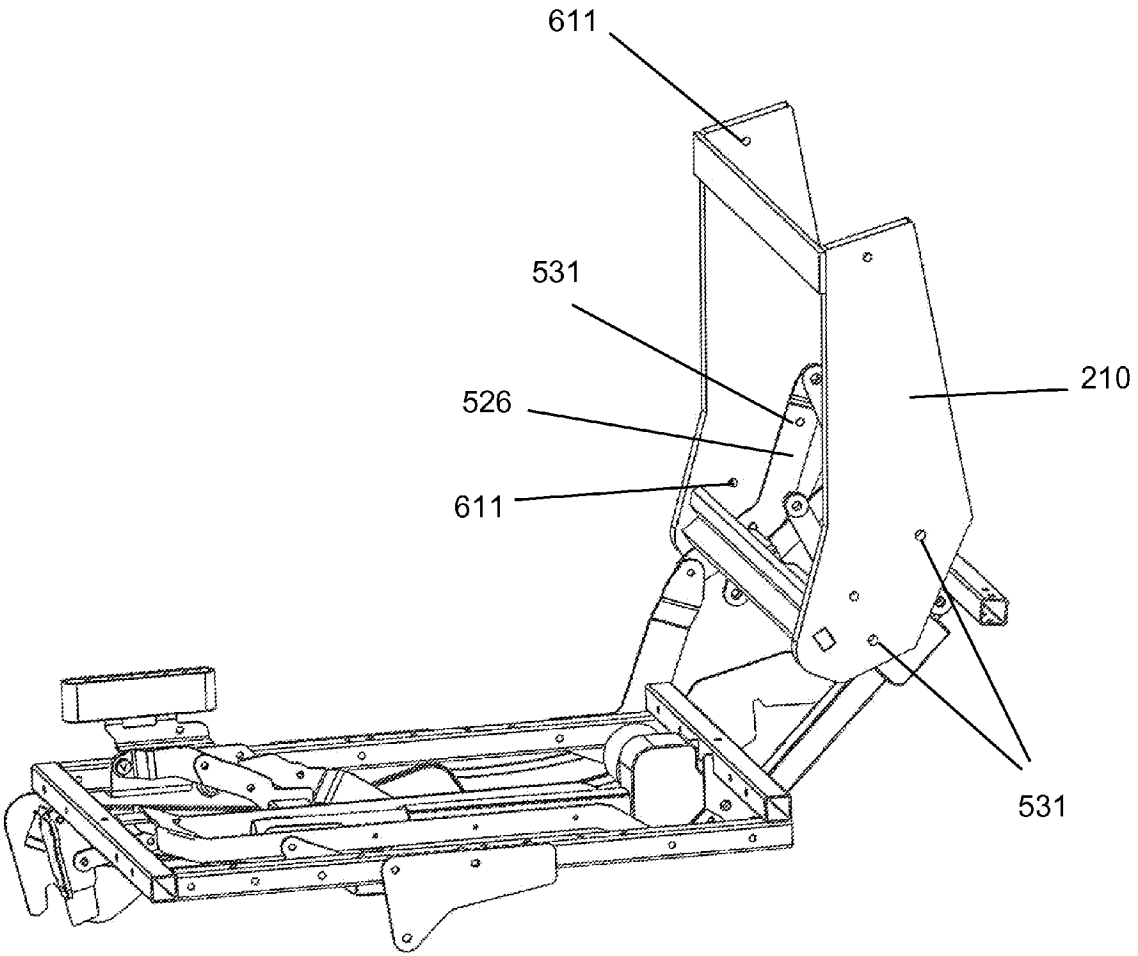
FIG. 18 shows a partial perspective view of the motion mechanism in an upright position.

The connecting arm 526 is fixably mounted to the backrest frame 200 through bolt holes 531 shown extending through the connecting arm 526 and the side panels 210, as best seen in FIG. 18. The fixed mounting may include bolts or screws passing through the bolt holes 531. Therefore, the connecting arm 526, the backrest frame 200, and the backrest cushion 2, are all relatively fixed together for movement with respect to the support frame 50.

The reclining motion of the seat 1 may be produced manually by the user without a motor. In another, potentially preferred embodiment, the reclining motion of the seat 1 may be driven by at least one motor. Use of a motor may facilitate the ability to useably position the backrest cushion 2 at a continuously variable angle of recline. As best seen in the top and bottom perspective views of FIGS. 14 and 15 respectively, the seat 1 may include a recline motor 530. The recline motor 530 may be a linear motor configured to expand and contract the distance between distally mounted ends thereof.

In the illustrated embodiment, the recline motor 530 is pivotally connected at an upper end to a bracket 533 that is mounted to a cross tube 536 extending between opposite rear swing arms 522. At the lower end, the recline motor 530 may be pivotally connected to one or more fixtures 340 fixed to the seatbox 303.

Extending the recline motor 530 pushes the seatbox 303 forward using the bracket 533 as a push point. Sliding the seatbox 303 relative to the mounting plate 504 will also cause translation of the connecting arm 526 relative to the support frame 50. Sliding the seatbox 303 in a forward direction is intended to cause the fourth pivot point 529 to translate further than the third pivot point 528. As can be seen when comparing FIGS. 10 and 11, the result is that the connecting arm 526 will recline as the seatbox 303 moves forward. Because the backrest frame 200, which supports the backrest cushion 2, is fixed to the connecting arm 526 at bolt holes 531, the backrest cushion 2 will recline along with the connecting arm 526. Specifically, expanding the recline motor 530 causes the distance between the seatbox 303 and the rear swing arm 522 to extend. The connecting arm 526 bridges this extended distance by moving from a relatively upright orientation to a relatively reclined orientation.

Extending the recline motor 530 initially moves the seatbox 303 forward using bracket 533 as a push point. However, the bracket 533 is fixed between the rear swing arms 522. The rear swing arms 522 are able to pivot relative to the support frame 50 about second pivot point 524. Thus the rear swing arms 522 are pulled forward as the seatbox 303 moves, which results in forward translation of the connecting arm 526. Therefore, as best understood when comparing FIGS. 10 and 11, the connecting arm 526 reclines and slides forward as the seatbox 303 and the rear swing arms 522 also move forward. This dual recline and slide motion assists in providing the ability for the backrest cushion 2 to avoid the closed back 3 and also helps to provide the necessary clearance between the backrest cushion 2 and the closed back 3 to provide a clearance through which the headrest 9 may travel.

The transition from the upright to the reclined positions of the seat 1 may be described in terms of three time segments where the rate of travel of different components should be properly controlled to allow for the closed back style seat 1 to operate correctly. Therefore, while the components are in simultaneous motion, the seatbox 303 travels quickly forward in a first time segment to clear the way for the recline and forward movement of the backrest cushion 2 in the second time segment. Once the recline and forward movement of the backrest cushion 2 forms a sufficient clearance between the backrest cushion 2 and the closed back 3, the headrest speeds up and quickly passes in-between during the third segment. The headrest 9 may be described as kicking forward into the fully extended position at the end of the transition process.

The recline motor 530, and the footrest motor 420, may be activated by a push button control box 110 which can be mounted for movement with the seatbox 303 at a location accessible adjacent to the seat cushion 6. In one embodiment, the control box 110 may extend to a height below the top surface of the seat cushion 6 to be substantially hidden from view. Hiding the control box 110 further maintains the seat's appearance as a stationary piece when in the fully closed position. The control box 110 may have separate buttons for opening and closing the footrest 5 via the footrest motor 420 and separate buttons for controlling the recline of the backrest cushion 2 using the recline motor 530. The control box 110 may be provided with a mode or buttons to simultaneously operate the recline motor 530 and the footrest motor 420.

Headrest Assembly

Figure 19:
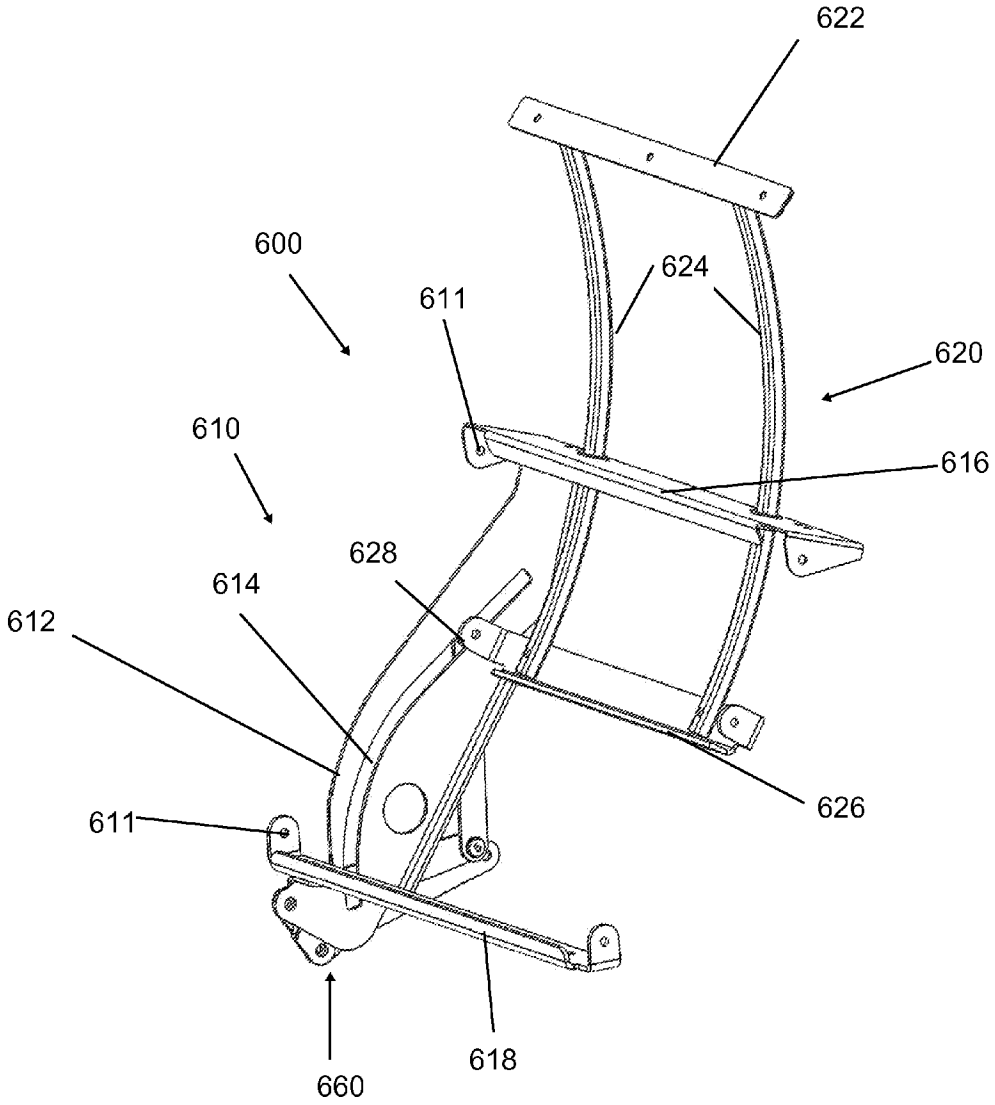
FIG. 19 shows an inside perspective view of the headrest assembly in the deployed position.
Figure 20:
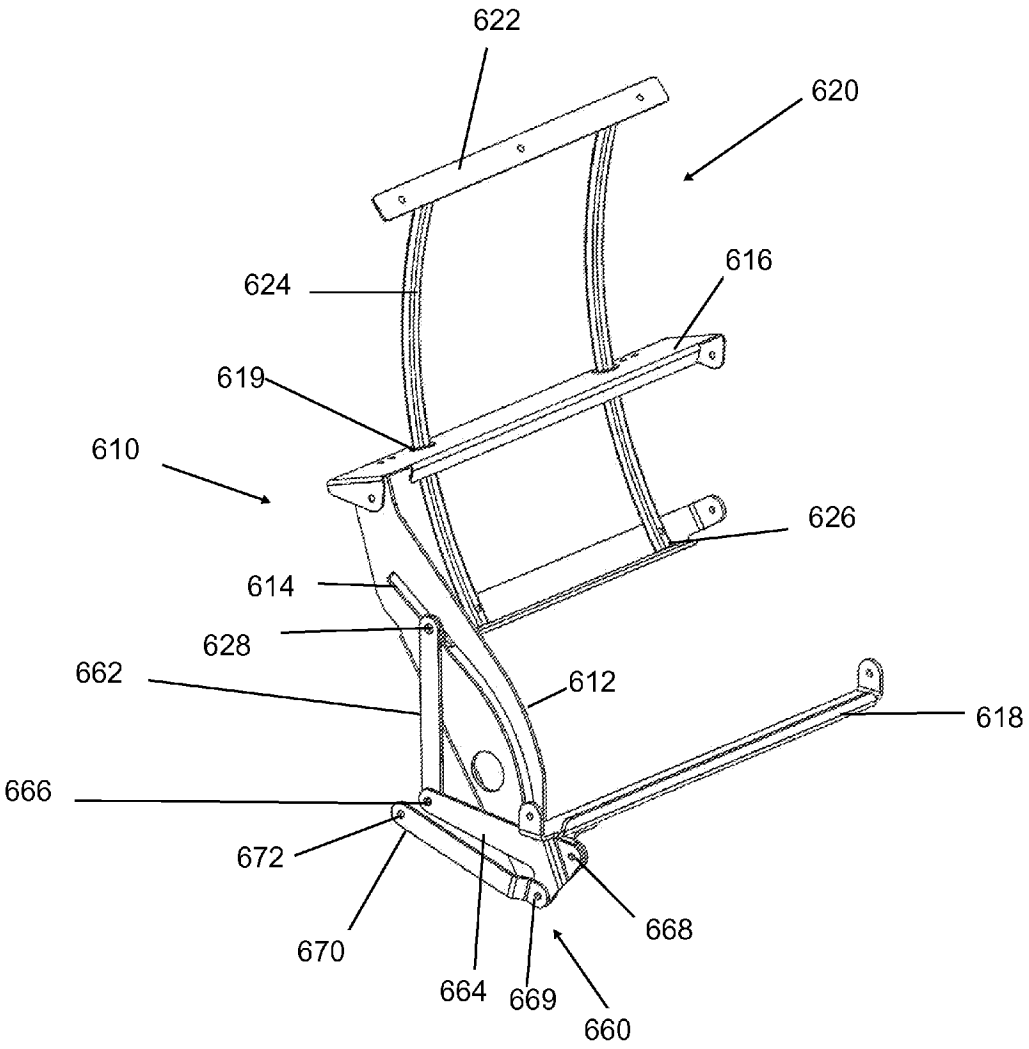
FIG. 20 shows an outside perspective view of the headrest assembly in the deployed position.
Figure 21:
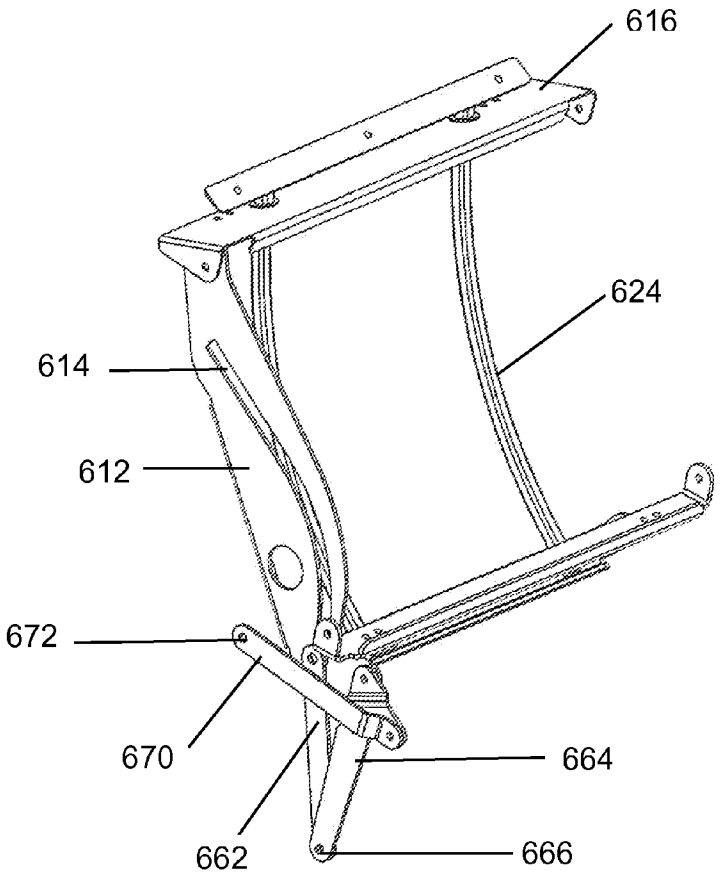
FIG. 21 shows an outside perspective view of the headrest assembly in the retracted position.

As best seen in FIGS. 19-21, headrest assembly 600 comprises a mounting subassembly 610, a headrest support subassembly 620, and a linkage subassembly 660. The mounting subassembly 610 may be indirectly fixed to the connecting arm 526, for example by attachment to the backrest frame 200 at mounting points 611 (see also FIG. 18). The mounting subassembly 610 may include a pair of track plates 612 (only one shown), each having a track 614. The shape of the track 614 is determined in order to provide properly timed motion and location of the headrest relative to the moving elements of the motion mechanism 100. The shape of the track 614 may also control the position of the headrest 9 relative to the mounting subassembly 610. In the illustrated embodiment, the track 614 is curved, concave open in a rearward direction. Generally the track 614 extends along a height direction of the track plate 612 and may be non-linear. The mounting subassembly 610 may include a top brace 616 extending between top ends of the track plates 612, and a bottom brace 618 extending between bottom ends of the track plates 612. The braces 616, 618 may be fastened, welded, or otherwise connected or integral with the track plates 612. In one embodiment, the headrest assembly 600 is mounted within the backrest frame 200 by bolts, screws, or related fasteners at mounting points 611. The headrest assembly 600 may be mounted to the side panels 210 through at least one of the track plates 612, the top brace 616, and the bottom brace 618.

The headrest support subassembly 620 is configured to be movable relative to the mounting subassembly 610 to allow the headrest 9 to deploy and retract relative to the backrest frame 200. The headrest support subassembly 620 includes a headrest support plate 622 upon which the headrest 9 can be attached. At least one leg 624 extends down from the headrest support plate 622. The at least one leg 624 is shaped to define the path of travel of the headrest 9 relative to the backrest frame 200. In the illustrated example, the at least one leg 624 is arched in a generally arc shape that is concave open toward the forward direction relative to the seat 1. The curved shape of the at least one leg 624 may be desired to extend the headrest 9 from a retracted position below the top surface, and behind a rear surface of, the backrest cushion 2 to a deployed position above the top surface and near a front surface of the backrest cushion 2.

Each leg 624 may slide through grooves, slots or apertures 619 within the top brace 616 and terminate at a connecting member 626 disposed horizontally between the track plates 612. Again, it should be appreciated that the shape of the leg 624 and the shape of the track 614 must be coordinated so that the leg 624 can travel smoothly though the apertures 619 and headrest 9 moves to its deployed upward position without unduly compressing the top rear portion 17 of the backrest cushion 2. Each end of the connecting member 626 may be provided with a headrest bushing 628 to be slidably disposed within a respective track 614 such that the lower end of the at least one leg 624 is constrained to follow the travel path defined by the track 614. Thus, as the headrest bushings 628 slide up the track 614, the headrest support plate 622 deploys away from the top brace 616, and as the headrest bushings 628 slide down the track 614, the headrest support plate 622 retracts toward the top brace 616.

The linkage subassembly 660 is best understood with respect to FIGS. 20 and 21. A first link 662 is pivotally connected at its top end to a headrest bushing 628 and at its lower end to a second link 664 at a fifth pivot point 666. The second link 664 may be considered an L-shape or a V-shape, having an apex and a pair of branches. The second link 664 pivotally connects to the first link 662 at a distal end of one of the branches at the fifth pivot point 666. The apex of the second link 664 is pivotally connected to the track plate 612 at an apex pivot point 668. A drive link 670 is pivotally connected at a joint 669 to an end of the other branch of the second link 664. A rear end of the drive link 670 is pivotally connected to the rear swing arm 522 at a sixth pivot point 672.

As the process of reclining begins, the distance between the sixth pivot point 672 and the apex pivot point 668 increases. The second link 664 rotates about apex pivot point 668 and raises the fifth pivot point 666. Translational motion of the fifth pivot point 666 relative to the track plate 612 causes the first link 662 to displace the headrest bushing 628 upwardly along the track 614, effectively deploying the headrest support plate 622 and the headrest 9 thereon. Put another way, as the seat 1 reclines, the sixth pivot point 672 in drive link 670 moves to the rear relative to the track plate 612, causing the second link 664 to rotate and the headrest bushing 628 and the headrest support plate 622 to elevate.

Again, the headrest assembly 600 is operably engaged with the recline assembly 500 by pivotally engaging a rear portion of the drive link 670 with the rear swing arm 522 at the sixth pivot point 672. The sixth pivot point 672 may be located between the second and third pivot points 524, 528 as best seen in FIG. 17. Forward movement of the seatbox 303 causes the backrest frame 200 to recline along with upward movement of the headrest support plate 622.

The shape of the track 614, the length and shape of the first link 662, the second link 664, the drive link 670 and the relative position of their pivot points all play a role in providing the proper timing and smooth motion of the motion mechanism 100. FIG. 20, which is substantially drawn to scale, illustrates one operable embodiment. In one example, the shape of the track 614 may be complicated because, not only is the sixth pivot point 672 moving relative to the support frame 50 (i.e. a fixed reference plane), but the apex pivot point 668 is also moving relative to the support frame 50 as the track plate 612 reclines with the backrest frame 200 and the connecting arm 526.

The result provided by the linkage subassembly 660 with the illustrated configuration is that the headrest 9 is made to extend outwardly from the top brace 616 at different rates during different parts of the headrest's travel. For example, even though the recline motor 530 may expand and contract at a uniform rate, the rate at which the leg 624 passes the top brace 616 will vary. Specifically, when the headrest 9 is extending or deploying, the initial rate of travel will be relatively slow. The slow initial rate allows time for the backrest cushion 2 to move out of the way, creating clearance between the backrest cushion 2 and the top cross member 58. Then the headrest 9 will experience a second, faster rate of travel into the fully deployed position once the clearance has been created.

In FIG. 21, headrest 9 is shown in is lowest position where the first and second links 662 and 664 are substantially vertical. It can be seen that the initial portions of recline motion of the backrest frame 200 cause rotation of the second link 664, but relatively little upward movement of the headrest bushing 628 because the fifth pivot point 666 is moving substantially in a horizontal direction for a given rotation of the second link 664 about the apex pivot point 668. Later, as seen in FIG. 20, the fifth pivot point 666 is moving substantially upward for a given rotation of the second link 664. Upward movement of the fifth pivot point 666 generates upward movement of the headrest bushing 628. This timing in effect mechanically delays the release of the headrest 9 into the fully extended position.

Figure 22:
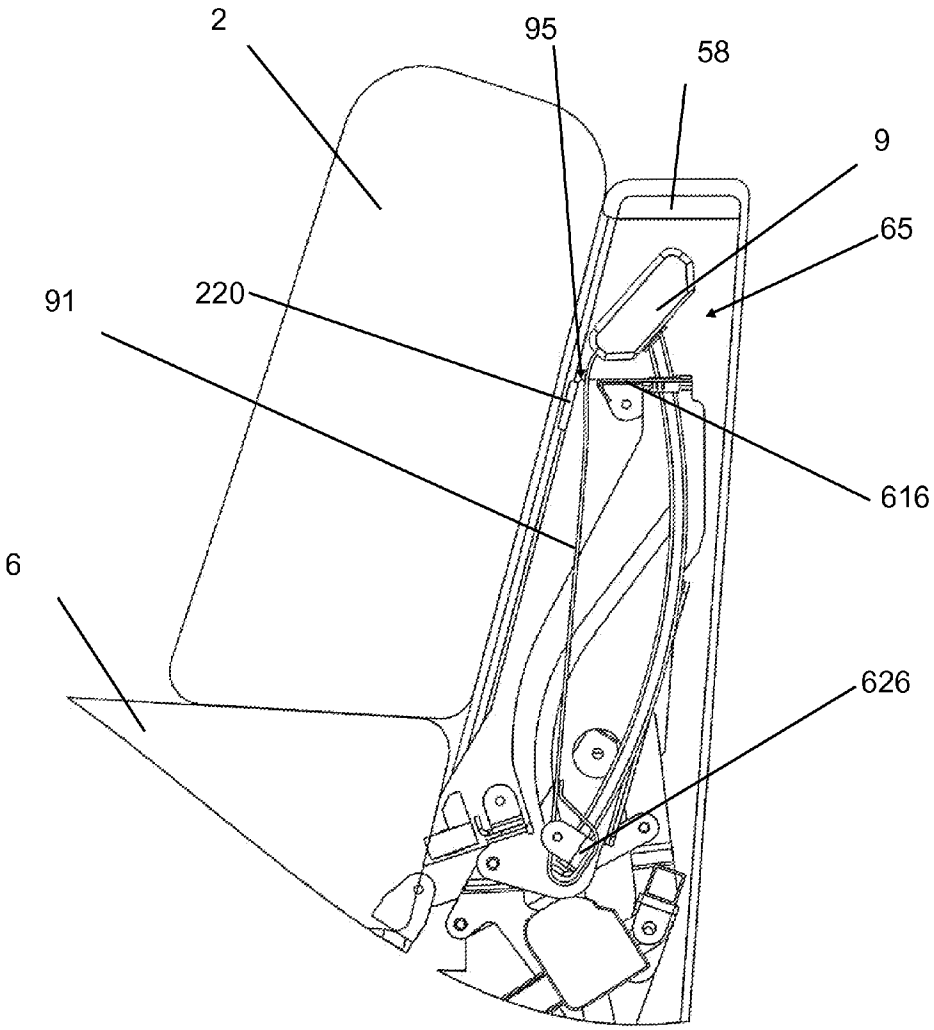
FIGS. 22-24 show lateral cutaway detail views of the headrest in positions fully down, partially down, and fully up respectively.
Figure 23:
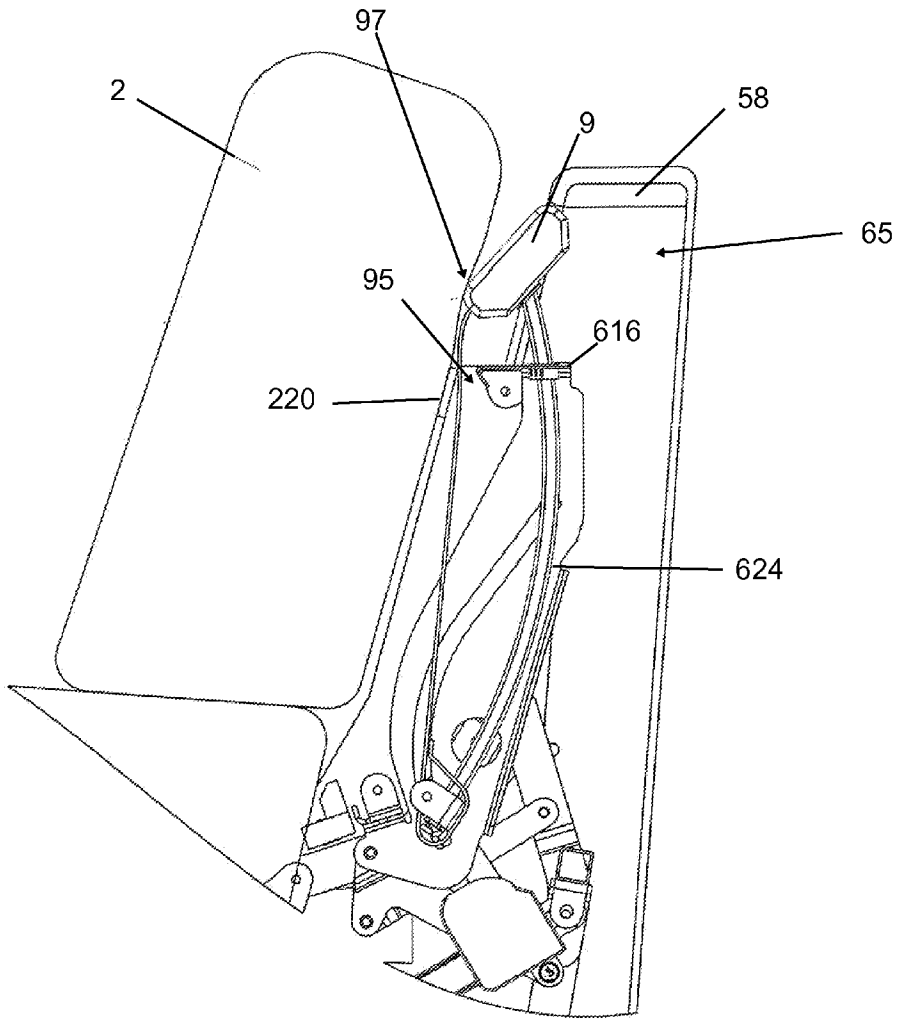
Figure 24:
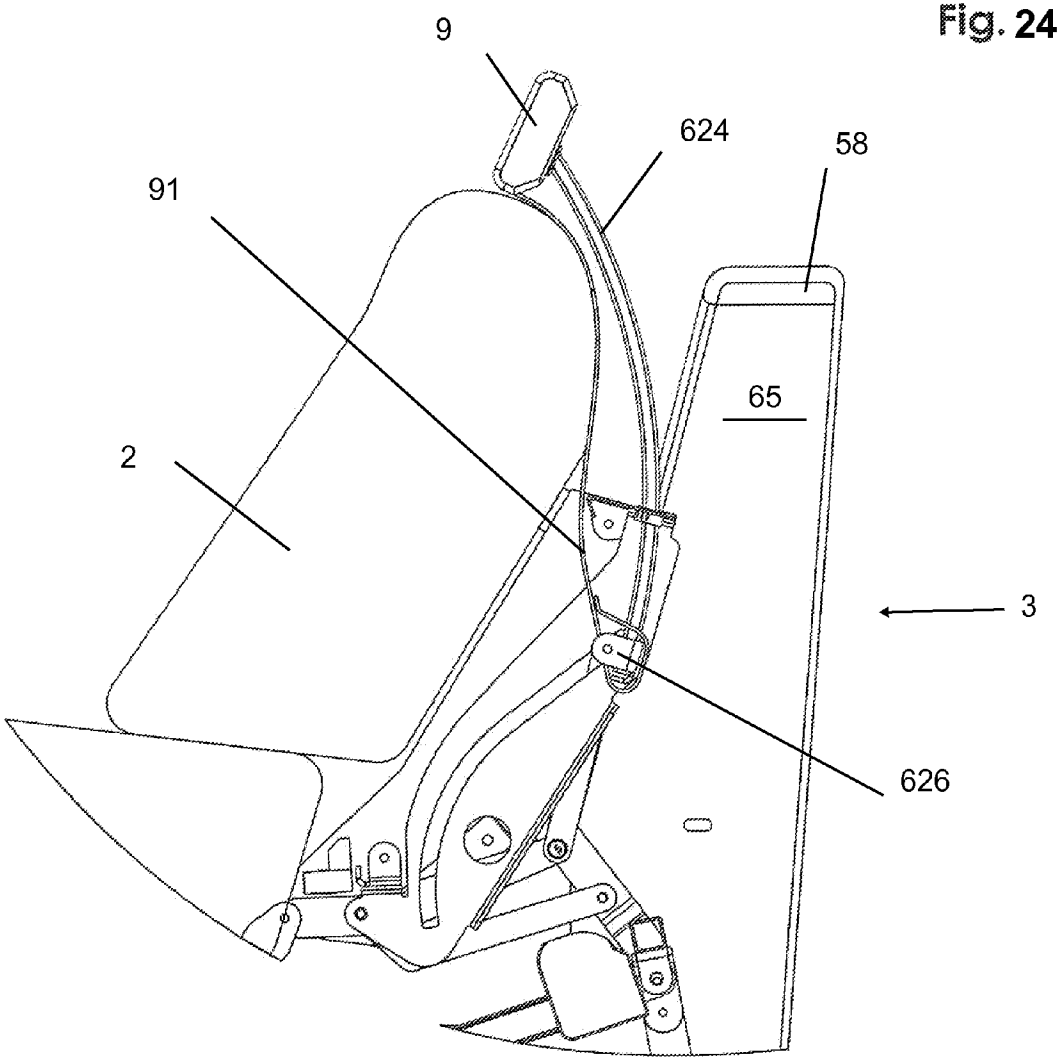

FIGS. 22-24 show detailed cutaway lateral views of one embodiment of the headrest 9 including a flap 91 at three progressive positions from fully down to fully up. As best seen in FIG. 19, the headrest support subassembly 620 provides a rigid four-sided structure that moves up and down by the movement of the headrest bushings 628 in the track 614. Returning to FIG. 22, the headrest 9 includes a flap 91 that is connected at its top edge to a lower edge of the headrest 9. At the lower end, the flap 91 is connected to the connecting member 626. The flap 91 may be held substantially taut between the headrest 9 and the connecting member 626. The flap 91 may be provided by a fabric material, such as the upholstery fabric used for the rest of the seat 1.

FIG. 22 shows the headrest 9 in is lowest position where it is completely hidden in the cavity 65. The flap 91 travels through a passage 95 defined between the top brace 616 and the upper horizontal member 220 of the backrest frame 200. The upper horizontal member 220 is substantially rigid and prevents rearward movement of the backrest cushion 2 that would block the passage 95. The upper horizontal member 220 is positioned sufficiently high relative to the backrest cushion 2 so that any webbing positioned below the upper horizontal member 220 can provide elastic support to the backrest cushion 2.

FIG. 23 shows the headrest 9 partially raised as its top edge moves past an entrance plane of the cavity 65 and clear of the top cross member 58. As the headrest 9 moves upward, its forward face slightly compresses the back face of the backrest cushion 2 at a location labeled 97. The headrest 9 is driven upward by the linkage subassembly 660 of the headrest assembly 600 by being connected at the sixth pivot point 672 to rear swing arm 522 of the recline assembly 500 (see FIG. 10). As the recline motor 530 extends and the headrest 9 is rising, the seatbox 303 moves forward and the angle alpha (FIG. 10) increases, thereby tipping the seat cushion 6 backward as its front edge elevates. The same forward movement of the seatbox 303 also causes the backrest frame 200 to move forward while simultaneously reclining. Headrest 9 can only be moved out of the cavity 65 when the top brace 616 has moved sufficiently forward and down to allow the top edge of the headrest 9 to clear the underside edge of the top cross member 58.

Excess forward movement of the seatbox 303 should be avoided. Excess forward displacement can cause the seat 1 to be unstable as a result of the combined center of gravity of the seat 1 and a seated occupant moving too far forward relative to the front of the arm 7. Accordingly, the movement of the respective components and assemblies of the seat 1 during recline are configured and synchronized to require the seatbox 303 to move forward only about 8 inches, while allowing the backrest cushion 2 to substantially recline, and allow the headrest 9 to move from a fully hidden location substantially within the cavity 65 to its fully elevated, deployed position. Specifically, the shape of the front and rear slots 512, 515 should be so configured as to cause the seat cushion 6 to tip backward to a comfortable angle alpha in a reclined position while at the same time not causing excess compression of the backrest cushion 2 at its lower edge 14.

The speed and extent of recline are controlled primarily by the relative design and location of the rearward seatbox mounting plate 322, the connecting arm 526, and the rear swing arm 522, and the relative location and separation of the second, third, and fourth pivot points 524, 528, 529. The speed and extent of upward movement of the headrest 9 are controlled by the linkage subassembly 660 and the relative location and separation of the pivot connections thereof. An operable embodiment is shown in the drawings where elements of the motion mechanism 100 have been substantially presented to scale.

The upward movement of the headrest 9 must be timed and coordinated with the downward and forward movement of the top brace 616 in order for headrest 9 to exit the cavity 65 and elevate toward its full upward position without hitting the top cross member 58 and without excessively compressing the top rear portion 17 of the backrest cushion 2. As seen in FIG. 24, a limited compression at the top rear portion 17 is caused by the flap 91, advantageously moving a top forward portion of the backrest cushion 2 forward to provide additional support to the neck and head areas of a person using the seat 1 in a reclined position. The flap 91 has the further advantage of ensuring that as the headrest 9 moves downward from its highest position, a lower edge of the headrest 9 does not tend to grab a top rear portion 17 of the backrest cushion 2, and thereby pull a portion of the backrest cushion 2 downward and backward such that the headrest 9 could be prevented and obstructed from moving downward. Put another way, the flap 91 may be taut, effectively providing a supporting surface behind the top of the backrest cushion 2 to prevent the weight of the user from displacing the backrest cushion 2 in a rearward direction. Rearward displacement of the backrest cushion 2 could otherwise inhibit the ability to retract the headrest 9.

Figure 25:
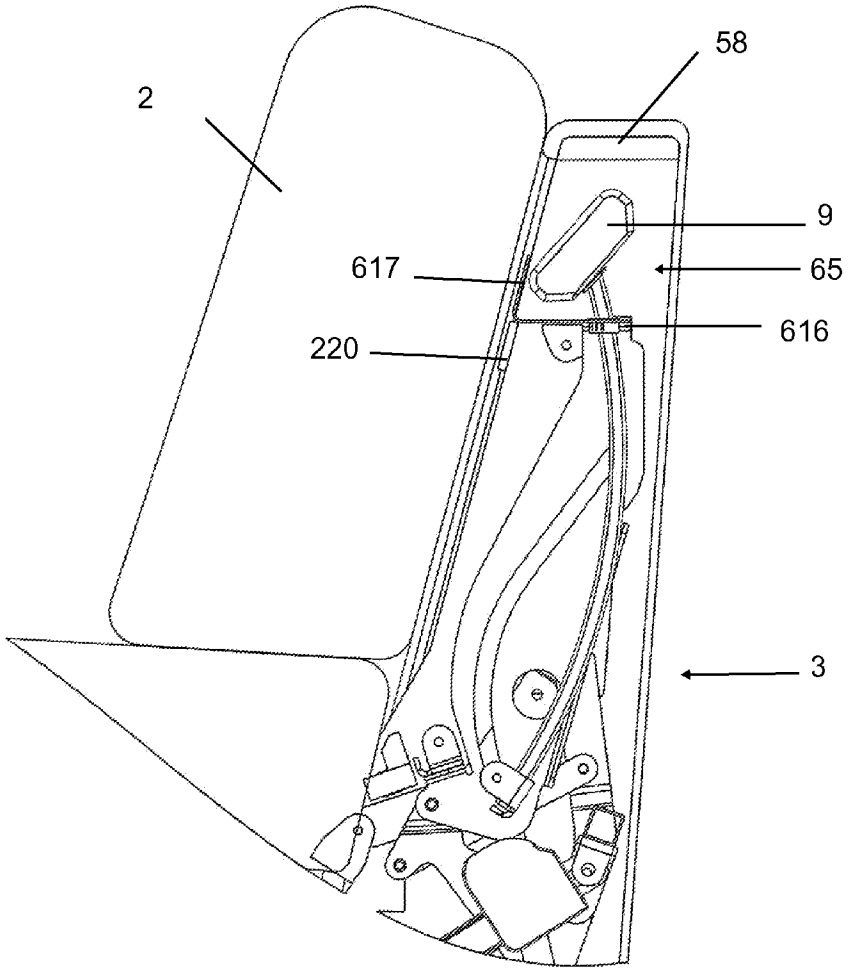
FIGS. 25-27 show lateral cutaway detail views of an alternative headrest in positions fully down, partially down, and fully up respectively.
Figure 26:
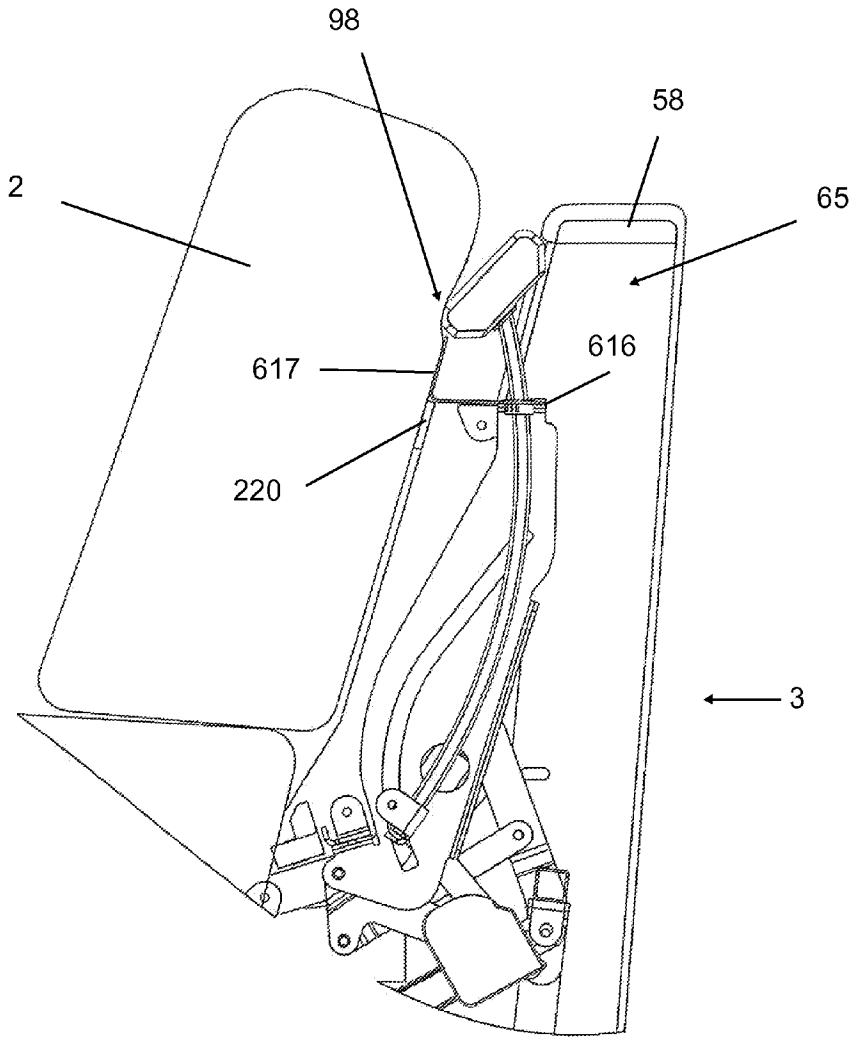
Figure 27:
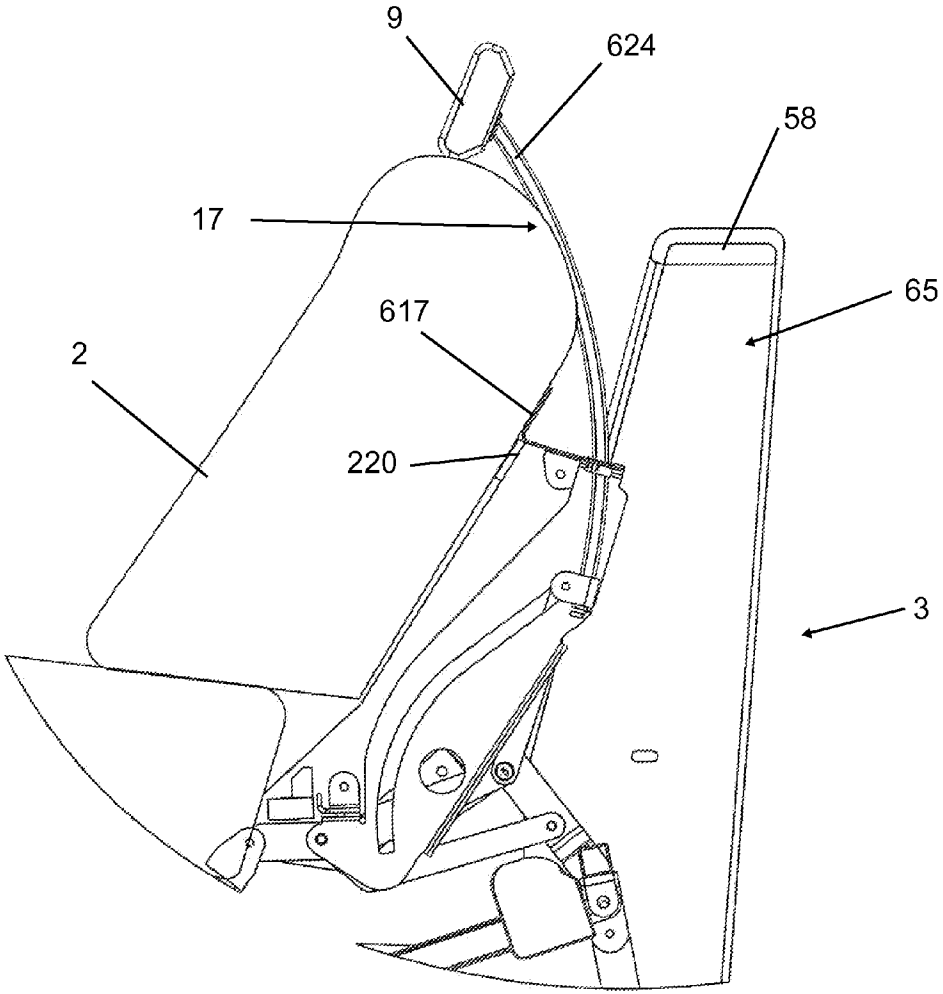

FIGS. 25-27 show an alternative embodiment of the headrest 9 that does not include a flap. FIG. 25 shows the headrest 9 fully down and hidden in the cavity 65. Upper horizontal member 220 is substantially rigid and prevents some rearward movement of the backrest cushion 2. Upper horizontal member 220 is positioned sufficiently high relative to the backrest cushion 2 so that webbing positioned therebelow can provide elastic support to the backrest cushion 2. In this embodiment, the top brace 616 includes an upwardly projecting flange 617 which helps to prevent rearward movement of a top end of the backrest cushion 2. Accordingly, the minimum opening into the cavity 65 necessary to allow the headrest 9 to enter and exit the cavity 65 is defined by a lower edge of the top cross member 58 and the top edge of the upwardly projecting flange 617.

FIG. 26 shows the headrest 9 exiting the cavity 65 with a minimum possible clearance to the top cross member 58 and the flange 617. As the headrest 9 moves upward, its forward face slightly compresses the back face of the backrest cushion 2 at an area labeled 98.

As seen in FIG. 27, a limited compression at the top rear portion 17 of the backrest cushion 2 is caused by the at least one leg 624, and advantageously moves a top forward portion of the backrest cushion 2 forward to provide additional support to the neck and head areas of a person using the seat 1 in the reclined position. Without the flap 91, the top rear portion 17 of the backrest cushion 2 will tend to move rearward, between the legs 624, and accordingly the extent of forward movement of a top forward portion of the backrest cushion 2 will be less than the embodiments where the flap 91 is included.

The shape and extent of the projection of the headrest 9 below the headrest support plate 622 is advantageously designed to minimize the possibility that a lower edge of the headrest 9 could grab the top rear portion 17 of the backrest cushion 2 and thereby pull a portion of the backrest cushion 2 downward and backward such that the headrest 9 could be prevented and obstructed from moving downward.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A seat, comprising:

a stationary support frame at least partially defining a cavity;

a backrest cushion;

a headrest; and a motion mechanism, wherein the motion mechanism comprises a headrest assembly configured to allow motion of the headrest between a retracted position and an extended position, wherein, when the headrest is in the retracted position, the headrest is hidden from view within the cavity of the support frame, and wherein, when the headrest is in the extended position, the headrest is visible above the backrest cushion;

wherein, in the retracted position, the headrest is positioned behind, and below a top surface of, the backrest cushion;

wherein the motion mechanism further comprises a recline assembly configured to allow motion of the backrest cushion between an upright position and a reclined position;

wherein, when the recline assembly is moving to the reclined position, the headrest assembly moves toward the extended position.

2. The seat according to claim 1, wherein:

the cavity is defined at least by a stationary top cross member, a pair of stationary sides, and a stationary back;

wherein the headrest is hidden between the backrest cushion and the support frame when in the retracted position.

3. The seat according to claim 1, wherein, during transition from the retracted position to the extended position, the headrest initially translates at a first rate, then translates at a second rate faster than the first rate.

4. The seat according to claim 1, further comprising a seat cushion;

wherein the motion mechanism further comprises a seat assembly supporting the seat cushion, wherein the seat assembly is connected to the recline assembly to displace the seat cushion in a forward direction relative to the support frame when the recline assembly moves from the upright position to the reclined position.

5. The seat according to claim 4, wherein the recline assembly comprises a pair of mounting plates attached to the support frame, each mounting plate comprising at least a front slot and at least a rear slot; and wherein the seat assembly comprises a first bushing traveling within the front slot and a second bushing traveling within the rear slot.

6. The seat according to claim 5, wherein the front slot has a shape different from the rear slot.

7. The seat according to claim 5, wherein a radius of curvature of the front slot is less than a radius of curvature of the rear slot such that the front of the seat cushion is raised higher relative to the rear of the seat cushion in the reclined position.

8. The seat according to claim 5, wherein a rear portion of the rear slot is substantially tangent to a horizontal line parallel with the floor, and forward movement of the second bushing causes a rear of the seat cushion to move forward and then increasingly upward.

9. The seat according to claim 4, wherein the recline assembly comprises:

a mounting plate attached to the support frame;

a rear swing arm pivotally connected to the mounting plate; and a connecting arm pivotally connected to the rear swing arm, wherein the connecting arm is attached to the seat assembly to drive the seat assembly to translate along the mounting plate, and wherein the rear swing arm is attached to the headrest assembly to drive the headrest between the retracted and extended positions.

10. The seat according to claim 1, wherein the recline assembly comprising:

a mounting plate attached to the support frame;

a rear swing arm pivotally connected to the mounting plate; and a connecting arm pivotally connected to the rear swing arm, wherein the connecting arm is operatively fixed to the backrest cushion to move therewith.

11. The seat according to claim 1, wherein the headrest assembly comprises:

a mounting subassembly fixed for movement with the backrest cushion;

a headrest support subassembly upon which the headrest is supported; and a linkage subassembly configured to drive the headrest support subassembly relative to the mounting subassembly.

12. The seat according to claim 11, wherein the mounting subassembly includes at least one track plate, the track plate having a track for constraining travel of the headrest support subassembly.

13. The seat according to claim 12, wherein the track is non-linear.

14. The seat according to claim 12, wherein the headrest support subassembly comprises:

a headrest support plate on which the headrest is mounted;

at least one leg extending from the headrest support plate;

a connecting member joined to the at least one leg; and a headrest bushing attached to the connecting member and sliding along the track.

15. The seat according to claim 14, wherein the at least one leg is arched so that the headrest is moved upward and forward relative to the backrest cushion when moving from the retracted position to the extended position.

16. The seat according to claim 1, further comprising a flap attached to, and extending downwardly from, the bottom of the headrest, the flap pushing the backrest cushion forward in the extended position.

17. The seat according to claim 1, wherein the motion mechanism further comprises a footrest assembly configured for opening and closing a footrest.

18. A seat, comprising:

a stationary support frame at least partially defining a fixed back of the seat;

a backrest cushion;

a headrest; and a motion mechanism, wherein the motion mechanism comprises a recline assembly configured to allow motion of the backrest cushion between an upright position and a reclined position, wherein the motion mechanism also comprises a headrest assembly configured to allow motion of the headrest between a retracted position and an extended position, wherein, in the retracted position, the headrest is positioned behind, and below a top surface of, the backrest cushion, between the backrest cushion and the fixed back;

wherein, when the recline assembly is moving to the reclined position, the headrest assembly moves toward the extended position.

19. The seat according to claim 18, wherein, during transition from the retracted position to the extended position, the headrest initially translates at a first rate, then translates at a second rate faster than the first rate.

20. The seat according to claim 18, further comprising:

a seat cushion;

wherein the motion mechanism further comprises a seatbox supporting the seat cushion;

wherein the recline assembly comprises a pair of mounting plates attached to the support frame, each mounting plate comprising at least a front slot and at least a rear slot; and wherein the seatbox comprises a first bushing traveling within the front slot and a second bushing traveling within the rear slot, wherein the front slot has a shape different from the rear slot such that the seatbox tilts rearwardly as the seatbox is moved forward by the recline assembly.

21. The seat according to claim 18, wherein the headrest assembly comprises:

a mounting subassembly fixed for movement with the backrest cushion;

a headrest support subassembly upon which the headrest is supported; and a linkage subassembly configured to drive the headrest support subassembly relative to the mounting subassembly, wherein the mounting subassembly includes at least one track plate, the track plate having a non-linear track for constraining travel of the headrest support subassembly.

22. The seat according to claim 18, further comprising a flap attached to, and extending downwardly from, the bottom of the headrest, the flap pushing the backrest cushion forward in the extended position.

* * * * *